US009157212B2

(12) United States Patent
Nolle et al.

(10) Patent No.: US 9,157,212 B2
(45) Date of Patent: Oct. 13, 2015

(54) CORROSION-RESISTANT SELF-LOCKING MANHOLE COVER

(71) Applicant: McGard LLC, Orchard Park, NY (US)

(72) Inventors: Eric R. Nolle, South Wales, NY (US); Jeffrey R. Sullivan, Boston, NY (US)

(73) Assignee: McGard LLC, Orchard Park, NY (US)

( * ) Notice: Subject to any disclaimer, the term of this patent is extended or adjusted under 35 U.S.C. 154(b) by 284 days.

(21) Appl. No.: 13/656,685

(22) Filed: Oct. 20, 2012

(65) Prior Publication Data

US 2014/0109486 A1 Apr. 24, 2014

(51) Int. Cl.
*B65D 45/00* (2006.01)
*E02D 29/14* (2006.01)

(52) U.S. Cl.
CPC ..... *E02D 29/14* (2013.01); *Y10T 292/0817* (2015.04)

(58) Field of Classification Search
CPC .. E02D 29/14; E02D 29/1427; E02D 29/1481
USPC ..... 292/256, 1, 5, 163, 175; 404/25; 52/19, 52/20, 21; 49/33, 463
See application file for complete search history.

(56) References Cited

U.S. PATENT DOCUMENTS

| | | | | |
|---|---|---|---|---|
| 1,287,290 | A | 12/1918 | Burton | |
| 1,400,399 | A | 12/1921 | Yaeche | |
| 1,458,391 | A * | 6/1923 | Burton | 137/371 |
| 2,363,567 | A | 11/1944 | Blakeman | |
| 2,698,775 | A * | 1/1955 | Courtwright | 403/192 |
| 3,120,032 | A * | 2/1964 | Burnette | 49/395 |
| 3,303,617 | A | 2/1967 | Hessburg, Jr. et al. | |
| 3,772,828 | A | 11/1973 | Chahley | |
| 3,797,286 | A | 3/1974 | Saporito | |
| 3,837,622 | A | 9/1974 | Gale | |
| 4,101,154 | A | 7/1978 | Kagstrom | |
| 4,577,478 | A | 3/1986 | Economopoulos et al. | |
| 4,723,866 | A | 2/1988 | McCauley | |

(Continued)

FOREIGN PATENT DOCUMENTS

| | | |
|---|---|---|
| CA | 2731613 | 4/2012 |
| GB | 2257736 A | 1/1993 |

OTHER PUBLICATIONS

"The LockDown System," LockDown-LockDry Division, Barton Southern Company, Inc., Apr. 2005, 1 page.

(Continued)

*Primary Examiner* — Kristina Fulton
*Assistant Examiner* — Christine M Mills
(74) *Attorney, Agent, or Firm* — Walter W. Duft

(57) ABSTRACT

A corrosion-resistant self-locking manhole cover includes a cover plate adapted to rest on a manhole cover support surface of a manhole frame. An anchor on the cover plate is adapted to engage the manhole frame at a first location in a manner that resists lifting of the cover plate proximate to such location. A locking member on the cover plate is movable between a locked position and an unlocked position. In the locked position, the locking member is adapted to engage the manhole frame at a second location in a manner that resists lifting of the cover plate proximate to such location. In the unlocked position, the locking member is disengaged from the manhole frame. A quick-latch mechanism is operable without using a key or other tool to release the locking member from its unlocked position to allow the locking member to return to its locked position.

16 Claims, 15 Drawing Sheets

(56) References Cited

U.S. PATENT DOCUMENTS

| | | | | |
|---|---|---|---|---|
| 4,902,165 | A | 2/1990 | Embree | |
| 4,928,615 | A * | 5/1990 | Williams | 114/203 |
| 4,964,755 | A | 10/1990 | Lewis et al. | |
| 5,070,564 | A | 12/1991 | Fey | |
| 5,082,392 | A | 1/1992 | Marchese et al. | |
| 5,328,291 | A | 7/1994 | Wisniewski | |
| 5,421,626 | A * | 6/1995 | Glachet | 292/256.5 |
| 5,458,257 | A * | 10/1995 | Muckelrath et al. | 220/562 |
| 5,533,641 | A * | 7/1996 | Argandona | 220/323 |
| 5,628,152 | A * | 5/1997 | Bowman | 52/20 |
| 5,827,007 | A | 10/1998 | Barton et al. | |
| 5,987,824 | A | 11/1999 | Fuller | |
| 6,199,414 | B1 * | 3/2001 | Chang | 70/168 |
| 6,550,294 | B2 | 4/2003 | Garguilo | |
| 6,739,796 | B1 | 5/2004 | Del Nero et al. | |
| 6,881,007 | B2 | 4/2005 | Dennis | |
| 7,201,533 | B2 | 4/2007 | DeGreef | |
| 7,201,534 | B2 | 4/2007 | Dennis | |
| 7,243,515 | B2 | 7/2007 | Meyer | |
| 7,347,070 | B1 | 3/2008 | Spector | |
| 7,484,909 | B2 | 2/2009 | Brady et al. | |
| 7,704,010 | B2 | 4/2010 | Nolle et al. | |
| 7,798,742 | B2 | 9/2010 | Nolle et al. | |
| 7,896,574 | B2 | 3/2011 | Nolle et al. | |
| 2003/0147693 | A1 | 8/2003 | Knak et al. | |
| 2006/0255596 | A1 * | 11/2006 | Yong | 292/173 |
| 2007/0252392 | A1 | 11/2007 | Newton | |
| 2007/0286677 | A1 | 12/2007 | Stadler | |
| 2008/0022731 | A1 | 1/2008 | Javaux | |
| 2008/0256997 | A1 | 10/2008 | Nolle et al. | |
| 2008/0260460 | A1 | 10/2008 | Nolle et al. | |
| 2009/0255183 | A1 * | 10/2009 | Nolle et al. | 49/57 |
| 2011/0222964 | A1 * | 9/2011 | Lacroix | 404/26 |

OTHER PUBLICATIONS

"Manhole Protection Underground Infrastructure Security," Manhole Barrier Security Security Systems, Inc., 2006, 4 pages.

E. Nolle, "Declaration of Eric R. Nolle Under 37 C.F.R. 1.56", Aug. 12, 2011, 25 pages.

CIPO, "Canadian Office Action", Canadian Patent Application No. 2,731,613, counterpart to U.S. Appl. No. 12/900,227, Jun. 27, 2012, 2 pages.

McGard LLC, "List of McGard LLC Patents or Patent Applications Treated as Related" Oct. 17, 2014, 2 pages.

* cited by examiner

CORROSION-RESISTANT SELF-LOCKING MANHOLE COVER

CROSS-REFERENCE TO RELATED APPLICATIONS

This application relates to U.S. patent application Ser. No. 12/125,663, filed on May 22, 2008, entitled "Self-Locking Manhole Cover" (now U.S. Pat. No. 7,896,754). This application further relates to U.S. patent application Ser. No. 12/900,227, filed on Oct. 7, 2010, entitled "Corrosion-Resistant Self-Locking Manhole Cover."

BACKGROUND

1. Field

The present disclosure relates to lock systems for securing access to manhole openings. More particularly, the disclosure concerns a self-locking manhole cover.

2. Description of Prior Art

By way of background, standard manhole covers are designed to be easily removed from manhole openings to allow access to underground facilities such as sewers, electrical and communication equipment vaults, and other infrastructure. This presents a security risk by allowing vandals, terrorists and others to gain unauthorized access to important assets, or to move about undetected via underground passageways. Standard manhole covers are also attractive targets for thieves who sell the covers for their scrap metal value.

Various manhole locking schemes have been proposed to address such security concerns. One technique is to simply bolt the manhole cover to the underlying manhole frame structure. Although very effective, this method involves retrofitting existing manhole covers and frames by drilling and tapping bolt holes, or requires that existing covers and frames be replaced with units having preformed bolt holes. Both alternatives are labor intensive and may be prohibitively expensive if the number of manhole locations is large.

Another manhole security technique involves the use of a lockable pan unit situated below a standard manhole cover. The pan unit is used to block the manhole opening, which means that the manhole cover itself does not require locking and does not have to be retrofitted or replaced. The pan unit is secured to the manhole frame by resting it on the same support surface that supports the manhole cover (typically a ring flange), and then locking the unit to the manhole frame. A disadvantage of such systems is the requirement for a separate pan that must be separately removed after the manhole cover is removed. Moreover, this solution does not prevent manhole cover theft.

Another manhole security technique involves providing a lock system on the manhole cover itself. A typical lock system includes a pair of retractable lock rods or bars that extend horizontally to engage the side-wall of the manhole frame or the underside of the ring flange or other support surface that supports the manhole cover. A rotatable key is used to rotate a locking apparatus or actuator that actuates the rods or bars into and out of locking engagement. By way of example, U.S. Pat. No. 4,964,755 discloses a manhole cover wherein a lock apparatus is turned by a key to operate a pair of lock rods. However, the lock rods are not self-locking and the key must be used to return the rods to their locked position once the manhole cover is in place. Moreover, the position of the lock rods in the locked position is fixed. Due to dimensional tolerances and differences between manhole frame designs, the lock rods may not firmly engage some manhole frames or may be overly tight in other manhole frames. U.S. Pat. No. 5,082,392 overcomes this problem by spring-biasing a pair of locking bars to their locked position. The locking bars affirmatively engage the manhole frame under the force of the biasing springs. A specially configured portion of a key mates with a vent hole in the manhole cover when the locking bars are in their unlocked position. This allows the locking bars to be held in the unlocked position during opening and closing of the manhole opening. However, the key must remain engaged with the manhole cover at all times when the cover is not covering the manhole, which may be inconvenient.

Applicants have observed a further disadvantage of existing locking manhole covers, namely, that such covers are susceptible to environmental degradation due to contact with sewer gases or other caustic agents. These harsh materials can corrode and degrade the cover locking components, thereby increasing service and repair costs.

It is to improvements in manhole opening security systems that the present disclosure is directed. In particular, applicants have perceived a need for a security device that improves upon previous designs by reducing the effort required to lock and unlock the device, that provides robust locking capability using an uncomplicated design that is easy to manufacture, and which is preferably corrosion-resistant.

SUMMARY

A corrosion-resistant self-locking manhole cover includes a cover plate adapted to rest on a manhole cover support surface of a manhole frame so as to be substantially flush with a top portion of the frame and a surrounding surface. An anchor on the cover plate is adapted to engage the manhole frame at a first location in a manner that resists lifting of the cover plate proximate to the first location. A locking member on the cover plate is movable between a locked position and an unlocked position. In the locked position, the locking member is adapted to engage the manhole frame at a second location in a manner that resists lifting of the cover plate proximate to the second location. In the unlocked position, the locking member is disengaged from the manhole frame. According to an example embodiment, the cover plate, the anchor and the locking member may comprise a nonmetallic corrosion-resistant material, as can other components of the disclosed cover. According to a further example embodiment, a quick-latch mechanism may be provided that is operable without using a key or other tool to release the locking member from its unlocked position to allow the locking member to return to its locked position. According to a further example embodiment, the locking member and the anchor may comprise first and second locking members that are each movable between a locked position in which the locking members are adapted to engage the manhole frame at first and second locations in a manner that resists lifting of the cover plate proximate to the first and second locations, and an unlocked position in which the locking members are not adapted to engage the manhole frame. The first and second locking members may be actively carried by first and second locking mechanisms that are secured to the cover plate using flanged anchors that are each mounted in a stepped bore that extends from an upper cover plate surface to a lower cover plate surface. The portions of the locking mechanisms that are secured to the cover plate may be formed from a suitable metal for added strength.

BRIEF DESCRIPTION OF THE DRAWINGS

The foregoing and other features and advantages will be apparent from the following more particular description of an example embodiment, as illustrated in the accompanying Drawings, in which.

DETAILED DESCRIPTION OF EXAMPLE EMBODIMENTS

Figure 1:
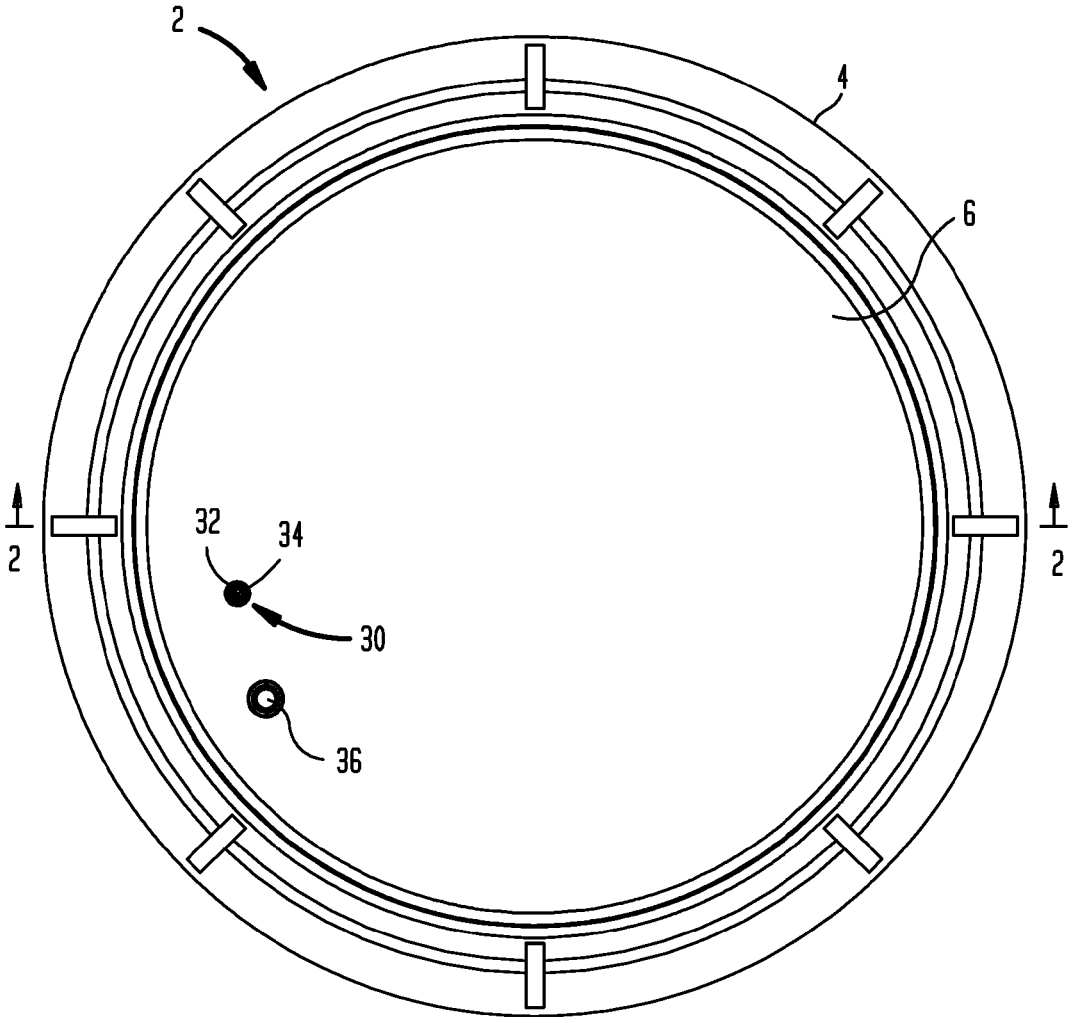
FIG. 1 is a plan view showing a manhole cover having an integrated locking system securing the manhole cover to a manhole frame.
Figure 2:
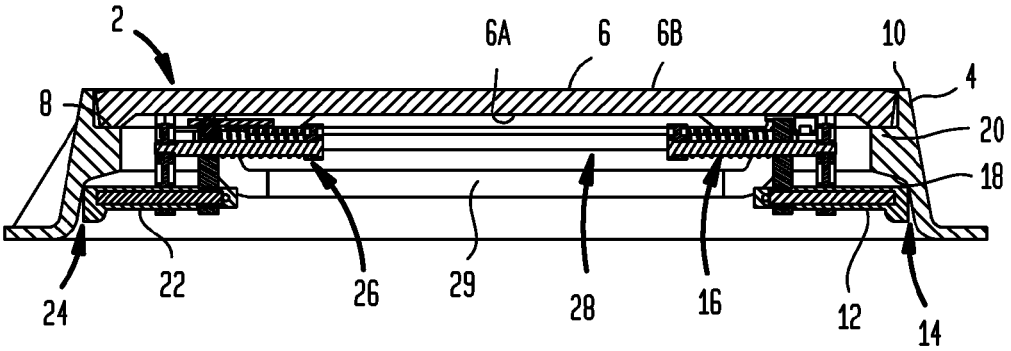
FIG. 2 is a cross-sectional view taken along line 2-2 in FIG. 1.

Turning now to FIGS. 1 and 2, a security manhole 2 includes a manhole frame 4 and a self-locking manhole cover plate 6 constructed in accordance with the present disclosure. The cover plate 6 is generally flat and can be made out of any suitable material that is of sufficient strength for the intended application. According to a preferred embodiment, the cover plate 6 comprises a material that is nonmetallic and corrosion-resistant. Forming the cover plate 6 from a polymer-based composite material (e.g. fiberglass, graphite-epoxy, etc.) is one way to implement such an embodiment. Such manhole covers are known in the art and have been available on the market for several years. Another alternative would be to form the cover plate 6 with a nonmetallic corrosion-resistant (e.g. polymeric) covering over an inner material that is metallic and which is not necessarily corrosion-resistant (e.g., steel). According to the preferred embodiment, the locking components of the manhole cover (described in detail below), which may be subject to sewer gas exposure, also comprise nonmetallic corrosion-resistant materials. Again, this may be achieved by forming substantially all of such components entirely from a nonmetallic corrosion-resistant material, or by ensuring that the exposed surfaces of each component are formed by such a material (even though interior portions may be metallic and not necessarily corrosion-resistant). In a most preferred embodiment, all cover plate components that are subject to sewer gas exposure, with the possible exception of the high-spring force biasing elements of the locking system (see below), may comprise nonmetallic corrosion-resistant materials. By way of example, such components can be made from high-strength nylon, polyester, nylon-covered polyester (for components that need wear resistance) and combinations thereof. For the biasing elements, which have certain strength and performance requirements that may preclude the use of nonmetallic materials, a non-corrosive metal, such as heat treated copper, is preferred. In other embodiments where corrosion is not a concern (such as non-sewer environments), different materials may be used depending on design preferences.

As can be seen in FIG. 2, the cover plate 6 is adapted to rest on a manhole cover support surface 8 (typically a ring flange of the manhole frame 4). If desired, the thickness of the cover plate 6 can be larger around its periphery than its interior region. In FIG. 2, the lower cover plate surface 6A extends downwardly in the vicinity of the support surface 8 to illustrate this feature. FIG. 2 also shows that the upper cover plate surface 6B is preferably substantially flush with a top portion 10 of the manhole frame and a surrounding surface (not shown) in which the manhole frame is situated (e.g., a roadway, walkway, parking lot, etc.). As shown in FIG. 2, an anchor 12 on the cover plate 6 is adapted to engage the manhole frame 4 at a first location 14 in a manner that resists lifting of the cover plate proximate to the first location. The anchor 12 may be constructed in various ways. In FIG. 2, the anchor 6 is configured as a sliding locking member supported by a locking mechanism 16 that may be mounted to the lower surface 6A of the cover plate 6. Alternatively, although not shown, the anchor 12 could be formed as a rigid bracket. One such bracket construction is disclosed in commonly-owned U.S. application Ser. No. 12/125,663, filed on May 22, 2008. The contents of said application are hereby incorporated herein by this reference in their entirety.

Insofar as the anchor 12 is embodied as a sliding locking member in the illustrated embodiment, it will be referred to as such throughout the remaining discussion. As will described in more detail below in connection with FIG. 14, the locking member 12 may be formed as a pin or piston having a defined configuration that facilitates an adjustment feature thereof. For strength reasons, an interior core of the locking member 12 may be constructed from fiberglass-filled polyester or other composite material and the outside may be formed with a covering composed of high-strength nylon or other low-friction polymer for wear resistance. As can be seen in FIG. 2, the locking member 12 engages an inwardly angled surface of the manhole frame 4. This contact point is below a lip 18 formed on the underside of a ring flange 20 whose upper surface provides the manhole cover support surface 8. As will be described in more detail below, the locking member 12 could also engage the lip 18 itself (which may be a more preferable contact point). The precise contact point of the anchor member on the manhole frame 4 will be determined by frame geometry and the configuration of the manhole cover locking components.

With continuing reference to FIG. 2, a second sliding locking member 22 identical in construction to the locking member 12 is also disposed on the cover plate 6. The locking member 22 engages the manhole frame 4 at a second location 24 that may be diametrically opposite to the first location 14 engaged by the anchor member 12. The locking member 22 is supported by a locking mechanism 26 that may be mounted to the lower surface 6A of the cover plate 6. Like the locking member 12, the locking member 22 engages an inwardly angled surface of the manhole frame below the lip 18 on the underside of the ring flange 20 (with other contact points also being possible). Thus, the locking member 22 is adapted to engage the manhole frame 4 at the second location 24 in a manner that resists lifting of the cover plate 6 proximate to the second location. As described in more detail below, the locking members 12 and 22 are operatively connected so that both components may be driven by a single drive mechanism (not shown in FIG. 1 or 2) and thereby retracted and disengaged from the manhole frame 4 in simultaneous fashion. In addition, the locking mechanism 16 may be structurally connected to the locking mechanism 26 to provide an integral locking system 28 that can be mounted as a unit to the cover plate lower surface 6A. A pair of generally U-shaped guard members 29 (one of which is shown in FIG. 2) may also be mounted to the lower surface 6A to protect the components of the locking system 28 from ground surface contact when the cover plate 6 is removed from the manhole frame 4.

Returning now to FIG. 1, a lock aperture 30 is formed at an off-center location on the cover plate 6. A central location could potentially also be used. The lock aperture extends through the cover plate 6 to the lower surface 6A. Seated in the lock aperture 30 is a lock housing 32 that retains a security lock 34. Details of the lock housing 32 and the security lock 34 may be seen in FIG. 13, and will be described in more detail below. The security lock 34 is part of a drive mechanism (not shown in FIG. 1 or 2) that is used to actuate the locking members 12/22. Using a security key tool (not shown) to engage and rotate the security lock 34, the cover plate 6 can be unlocked when desired by retracting the locking members 12/22 so that they disengage from their respective points of contact with the manhole frame, and so that they also clear the lip 18. This allows the cover plate 6 to be removed from the manhole frame 4 to allow access to the manhole access opening within. An access hole 36 may also be disposed on the cover plate 6 adjacent to the lock aperture 30. The access hole 36 is provided for releasing a latch (not shown in FIG. 1) that maintains the locking members 12/22 in their unlocked position when the cover plate is removed from the manhole frame 4 (as described in more detail below).

FIGS. 3-10 collectively illustrate the locking system 28 according to an example embodiment thereof. FIGS. 3-6 show the locking system 28 in the locked position in which the locking members 12/22 are fully extended. FIGS. 7-10 show the locking system 28 in the unlocked position in which the locking members 12/22 are fully retracted. The locking mechanism 16 that carries the locking member 12 has substantially the same construction as the locking mechanism 26 that carries the locking member 22. Both mechanisms 16/26 respectively include a fixed front tower 16A/26A, a movable carriage 16B/26B, a rear tower 16C/26C, and a connector 16D/26D that may be implemented as a carriage bolt to interconnect the front and rear towers (see FIGS. 14-16 for carriage bolt configuration details). Each of the foregoing components can be made from a durable polymer material, such as high-strength nylon. The geometries and configurations of these components as shown in FIGS. 3-10 are for purposes of example only. Other component geometries and configurations could also be used according to design preferences and based on the materials used in their construction.

The locking members 12/22 are attached to the movable carriages 16B/26B of their respective locking mechanisms 16/26. In particular, the locking members 12/22 may be removably connected to a central apertured flange 16E/26E on the carriages 16B/26B. As shown in FIGS. 4, 6, 8 and 10, retainer pins 12A/22A and lock nuts 12B/22B may be used to provide the removable connection. A cotter pin (not shown) may be used to prevent inadvertent detachment of the lock nuts 12B/26B form the retainer pins 12A/22A. Further locking member connection details are described in more detail below in connection with FIG. 14. Each movable carriage 16B/26B functions as a main locking member support element. The locking members 12/22 are also slidably supported by a central apertured flange 16F/26F on the front towers 16A/26A of each locking mechanism 16/26. Each front tower 16A/26A thus functions as secondary locking member support element.

Figure 4:
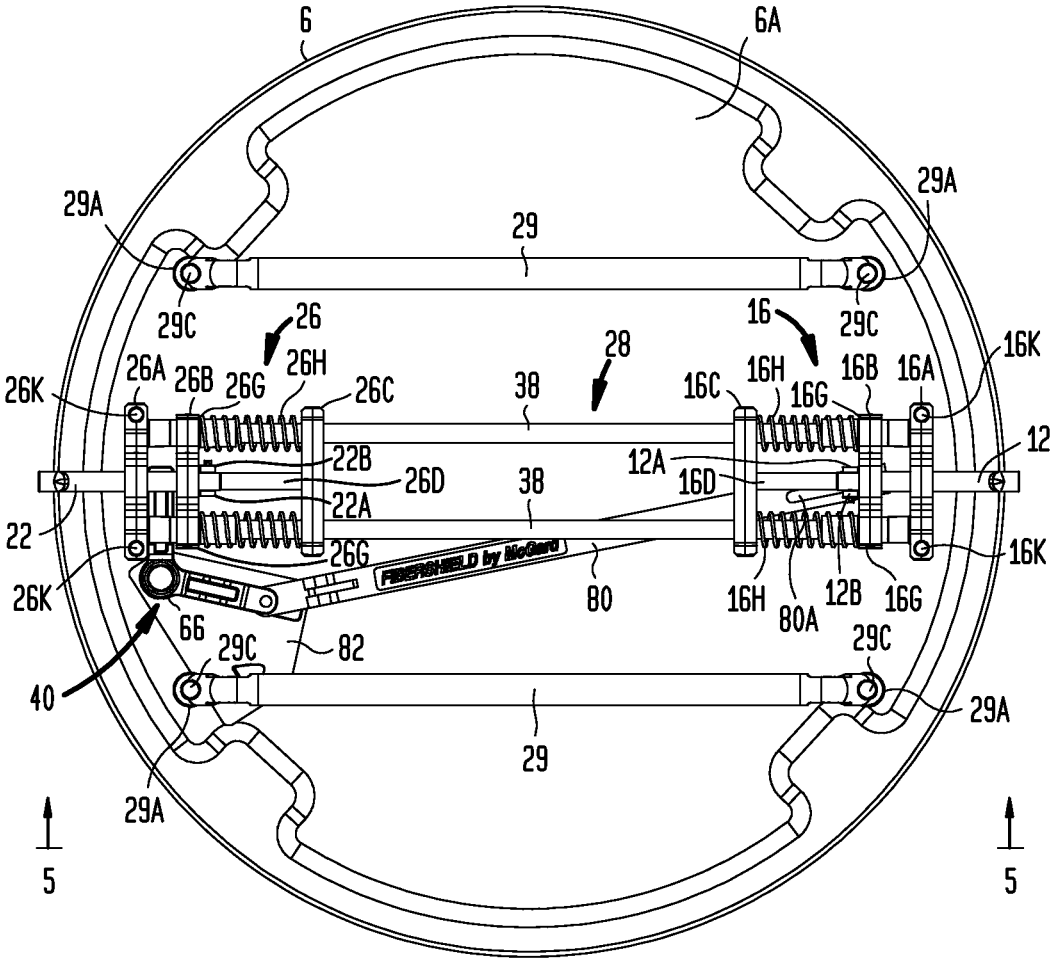
FIG. 4 is a plan view of the bottom of the manhole cover of FIG. 1 with the locking components thereof in a locked position.
Figure 5:
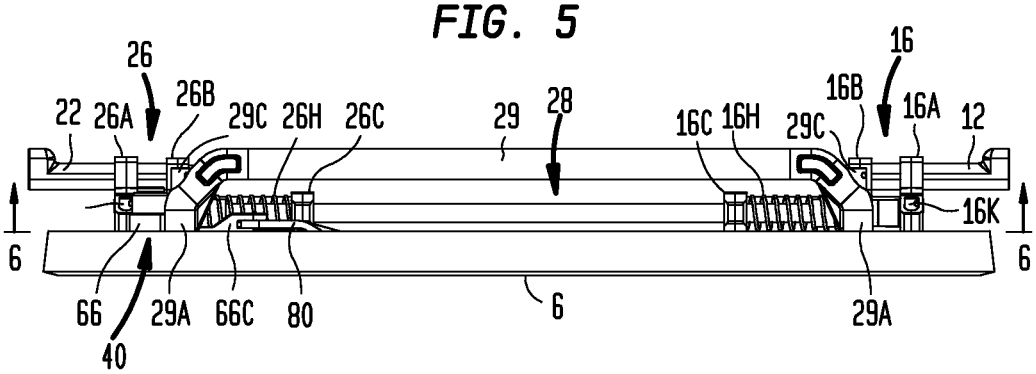
FIG. 5 is a cross-sectional view taken along line 5-5 in FIG. 4.
Figure 6:
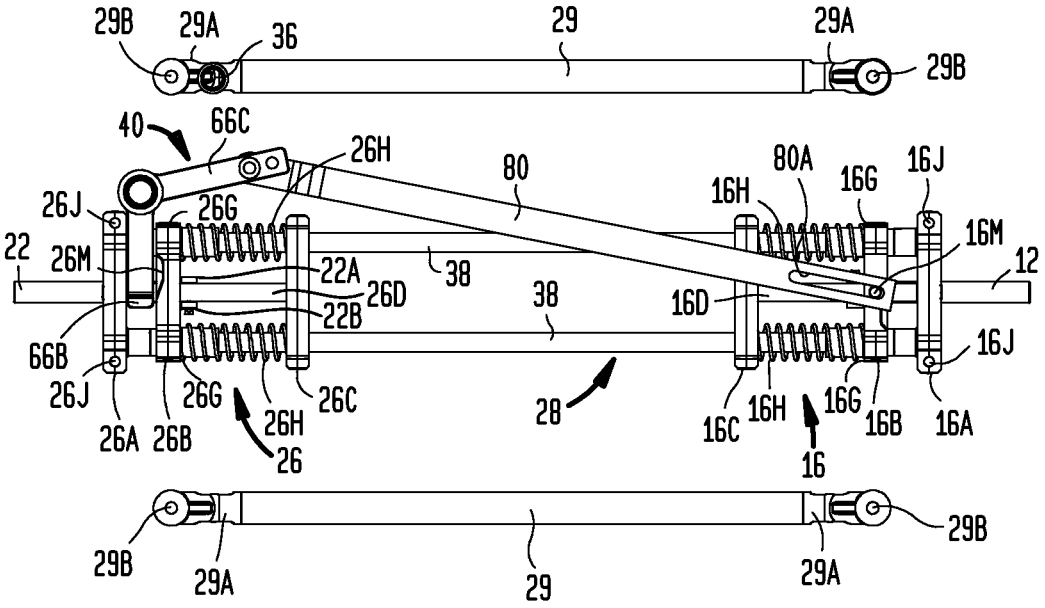
FIG. 6 is a cross-sectional view taken along line 6-6 in FIG. 5.

The movable carriage 16B/26B of each locking mechanism 16/26 has a pair of apertured side flanges 16G/26G that are carried for sliding movement on a pair of bridge members 38 that interconnect the locking mechanisms 16/26 to establish the unitary locking system 28. For strength reasons, the bridge members 38 may be manufactured from fiberglass-filled polyester, such as by using a pultrusion process. The bridge members 38 function as guide rods or shafts that stabilize the movable carriages 16B/26B and help to control and direct their movement. As can be seen in FIGS. 4 and 6, the side flanges 16G/26G of each movable carriage 16B/26B may be formed with integral sleeves. These sleeves help maintain the carriages 16B/2B in a stable upright orientation during their sliding movement between the locked and unlocked positions. Each movable carriage 16B/26B is also carried for sliding movement on one of the connectors 16D/26D by way of an aperture in the central body portion of each movable carriage. This aperture is located at the intersection of the carriage flanges 16B/26B and 16E/26E. The connectors 16D/26D thus also function as guide rods or shafts for the movable carriages 16B/26B. In each locking mechanism 16/26, the combination of the front tower 16A/26A, the rear tower 16C/26C and the connector 16D/26D, may be thought of as providing one embodiment of a locking mechanism base support structure on which the movable carriage members 16B/26B and the locking members 12/22 are supported for sliding movement.

On each locking mechanism 16/26, the movable carriage 16B/26B is resiliently biased toward the front tower 16A/26A by a pair of coil springs 16H/26H. The coil springs 16H/26H mount on the bridge members 38 and extend between the movable carriage 16B/26B and the rear tower 16C/26C. The springs 16H/26H thus provide one embodiment of a resilient biasing mechanism for resiliently biasing the locking members 12/22 to their locked positions. As previously stated, it may be desirable to form the coil springs 16H/26H from a non-corrosive metal. One such metal is heat-treatable copper. Other candidate materials include titanium, nickel-chrome, as well as other metals and alloys. nonmetallic materials could potentially also be used provided they have suitable mechanical properties.

Each front tower 16A/26A includes a pair of lateral mounting flanges 16I/26I that are used to secure the front towers to the lower surface 6A of the cover plate 6. Within each lateral mounting flange 16I/26I is a through-bore 16J/26J (shown in FIGS. 6 and 10) that is formed with an upper counterbore (see FIG. 13) to receive a fastener (not shown), such as a threaded screw or bolt, that attaches to the cover plate 6. To facilitate such attachment, the cover plate 6 may include threaded anchor inserts (not shown) that are seated in the cover plate lower surface 6A. For improved strength, the fasteners used to mount each front tower 16A/26A can be made from stainless steel or another metal that may have some degree of corrosion-resistance. To provide additional protection against corrosive agents, the fasteners may be sealed within their respective counterbores by way of sealing plugs 16K/26K made from a polymer (such as nylon) or other nonmetallic corrosion-resistant material. As described in more detail below in connection with FIG. 14, each sealing plug 16K/26K may carry an O-ring gasket to perfect the seal within each counterbore chamber. In addition, a sealing gasket (not shown) may be placed below the lateral mounting flanges 16I/26I of each front tower 16A/26A at their point of attachment to the cover plate lower surface 6A.

Figure 3:
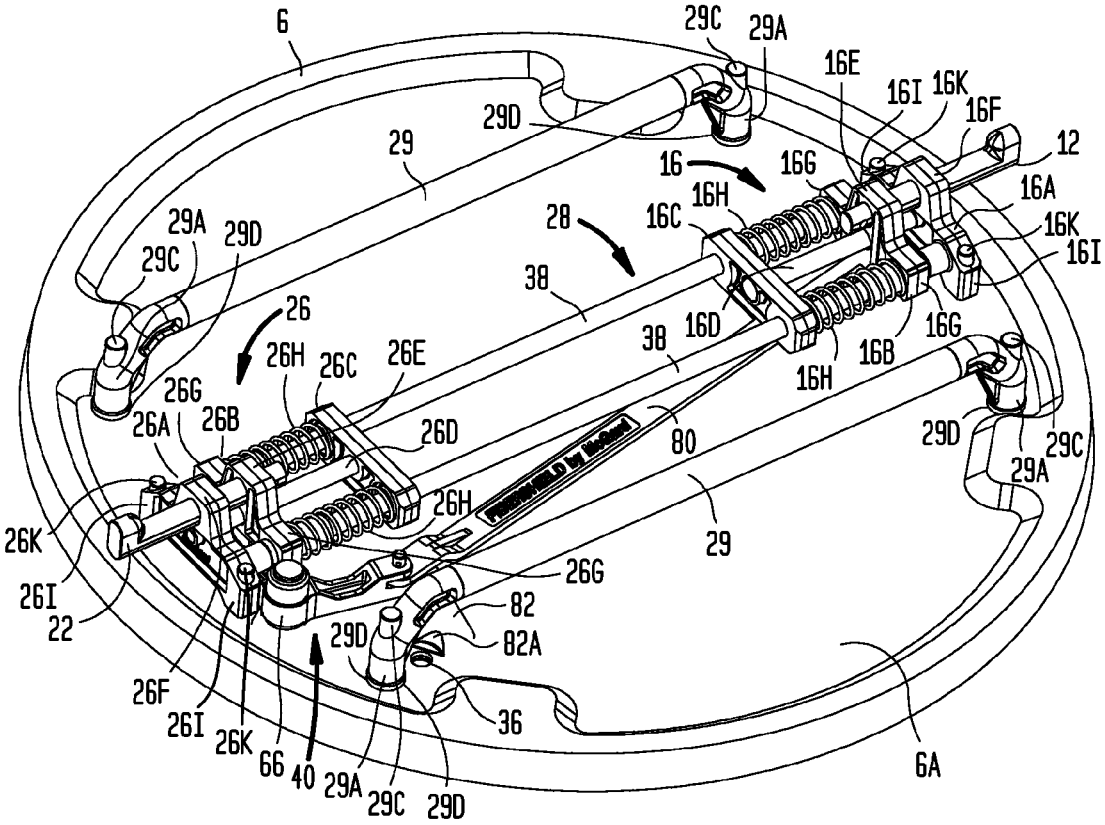
FIG. 3 is a perspective view showing the bottom of the manhole cover of FIG. 1 with the locking components thereof in a locked position.
Figure 7:
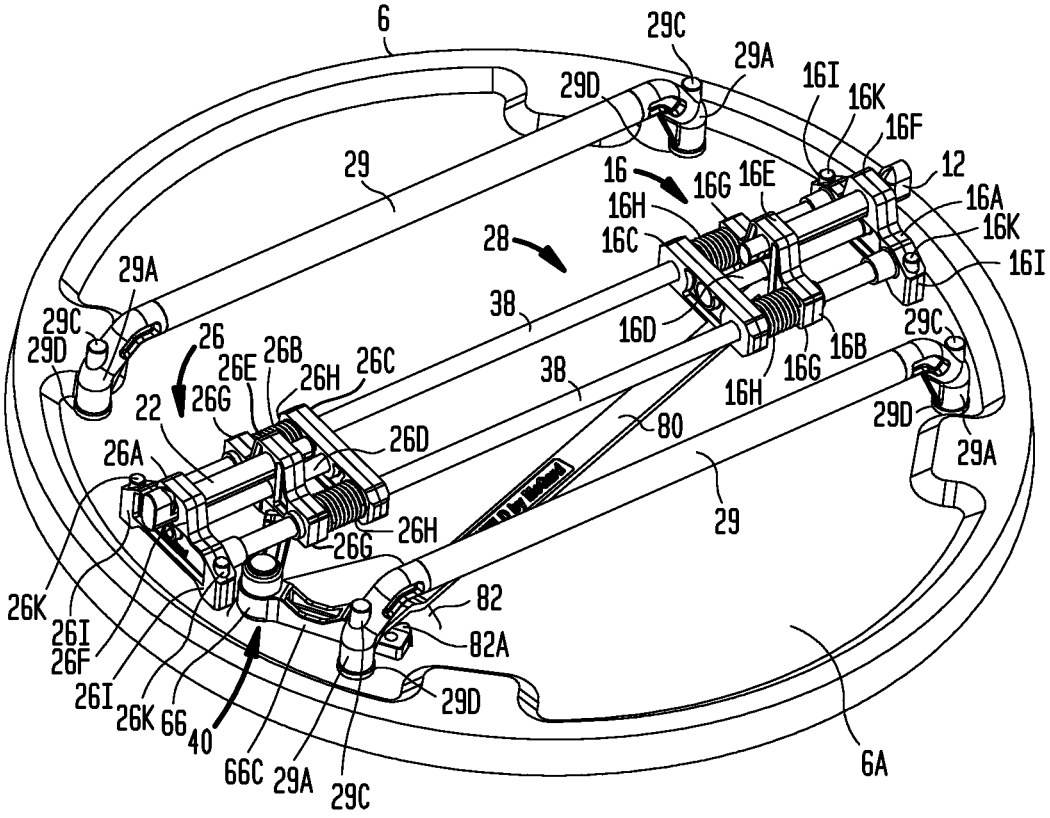
FIG. 7 is a perspective view showing the bottom of the manhole cover of FIG. 1 with the locking components thereof in an unlocked position.
Figure 8:
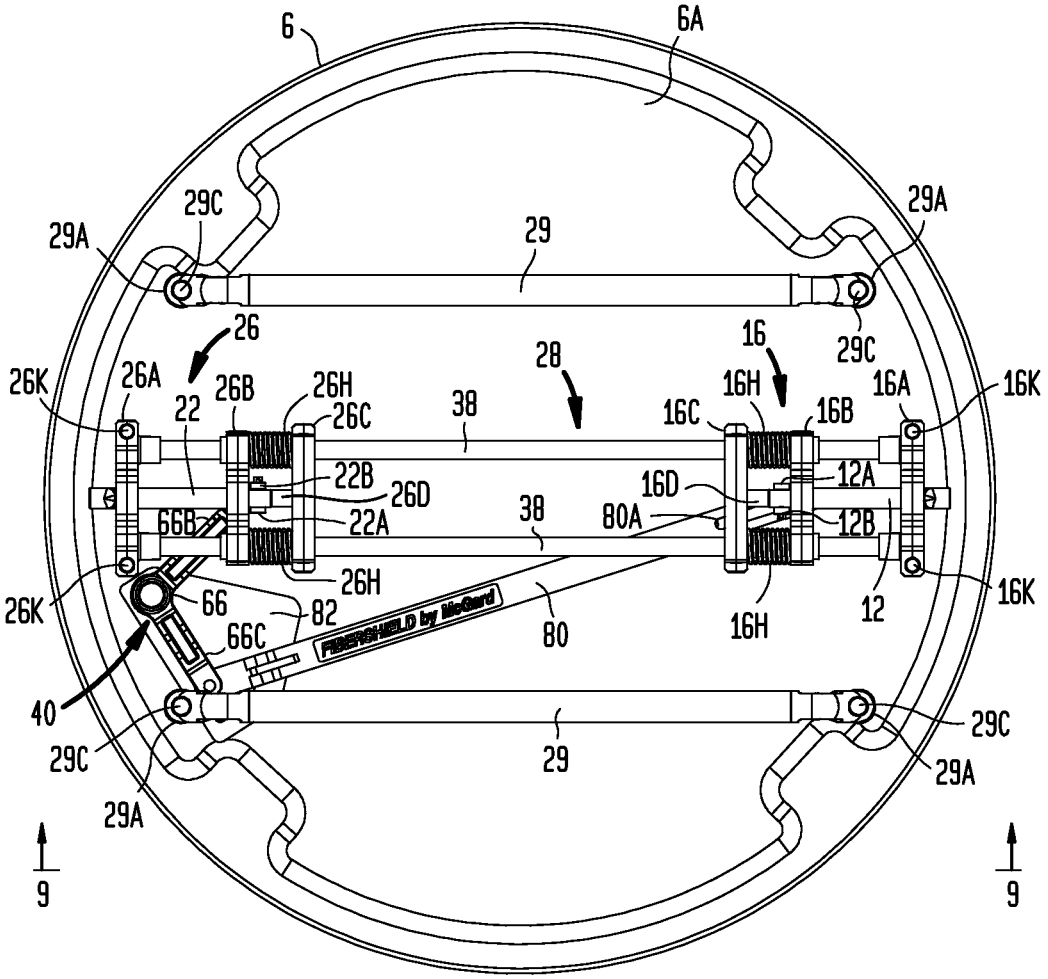
FIG. 8 is a plan view of the bottom of the manhole cover of FIG. 1 with the locking components thereof in an unlocked position.
Figure 9:
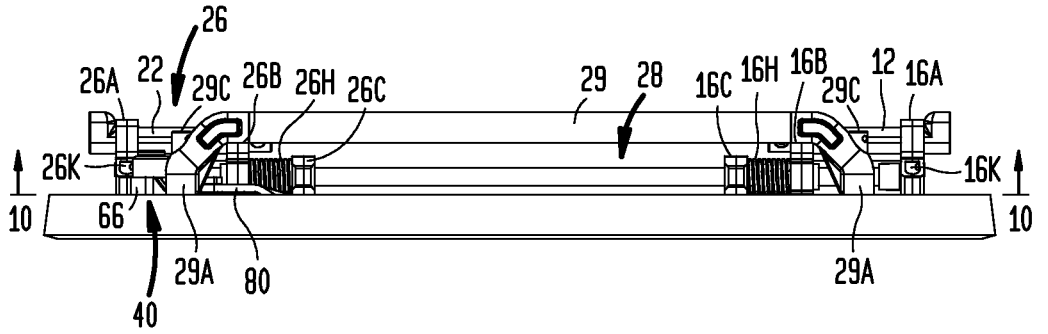
FIG. 9 is a cross-sectional view taken along line 9-9 in FIG. 8.

As can be best seen in FIGS. 3 and 7, each of the guard members 29 can be mounted to the lower surface 6A of the cover plate 6 using the same sealed fastener technique. Each guard member includes a pair of standoff ends 29A that attach to the cover plate lower surface 6A. Each standoff end 29A may be formed with a through-bore 29B (shown in FIGS. 6 and 10) formed with an upper counterbore that receives a fastener (not shown). The counterbore chamber may be sealed by way of a sealing plug 29C. A sealing gasket 29D may also be placed below the guard member standoff ends 20A at their point of attachment to the cover plate lower surface 6A.

The ends of the bridge members 38 are anchored to the lateral mounting flanges 16I/26I of the front tower 16A/26A of each locking mechanism 16/26. This creates a common interconnecting bridge structure that allows the locking system 28 to be mounted as an integral unit to the cover plate lower surface 6A. The bridge members 38 also extend through apertures in the rear towers 16C/26C to help support the rear towers in a stable position. As previously mentioned, the bridge members also help stabilize the movable carriages 16B/26B.

Notwithstanding the foregoing advantages of the unitary locking system 28, it will be appreciated that an alternative locking system could be implemented with individual locking mechanisms that are not interconnected by a central bridge structure. However, additional fasteners and apertures in the cover plate would likely be required to support such separate lock mechanisms, which may be undesirable. It may also be possible to construct a unitary locking system without the use of two bridge members 38. For example, instead of the bridge members 38, a single long carriage bolt or other connector could be installed to replace the individual connectors 16D/26D and thereby interconnect the front and rear towers of both locking mechanisms 16/26 into a single unit. A possible disadvantage of such a construction is that the movable carriages 16B/26B and the rear towers 16C/26C might be able to rotate about the single connector. Such rotation could potentially bind the locking members 12/22 as they move between their locked and unlocked positions. It is also worthy of mention that although the locking system 28 has two locking members 12 and 22, it would be possible to provide one or more additional locking members depending on design preferences and cost considerations.

Other design alternatives could also be implemented in the locking system 28. For example, in lieu of the two coil springs 16H/26H, it may be possible to use a single coil spring mounted on the connectors 16D/26D. However, a larger spring may be required to provide an equivalent spring force. The configuration of the front towers 16A/26B, the movable carriage 16B/26B and the rear towers 16C/26C could also be modified. For example, although the front towers 16A/26A and the movable carriages 16B/26B are each shown with a configuration that includes a central upper flange and a pair of lateral or side flanges, other geometries may be used, such as a generally triangular, oval or rectangular configuration. The geometry of the rear towers 16C/26C could likewise be changed. Material choices may affect both the configuration and size of the various locking system components. In the embodiment shown in FIGS. 3-10, all of the exposed components except the springs 16H/2H are made entirely of polymeric materials. Although the fasteners used to attach the locking mechanisms 16/26 to the cover plate are metal, they are not exposed because they are captured within sealed counterbore chambers and are thus covered by nonmetallic corrosion-resistant materials. It may be possible to fabricate additional components in this manner, i.e., from metal with a nonmetallic corrosion resistant covering (such as by applying a polymer-on-metal coating). In that case, the components of the locking system 38 could perhaps be smaller in size and of different geometry due to the higher strength of the metal construction. However, construction costs may increase insofar as metal is generally more expensive than plastic. Thus, applicants submit that the substantially all-plastic construction used in the locking system embodiment of FIGS. 3-10 may be more practical than an alternative construction in which more of the components include metal. For that reason, a substantially metal-free construction as disclosed herein is preferred.

Figure 10:
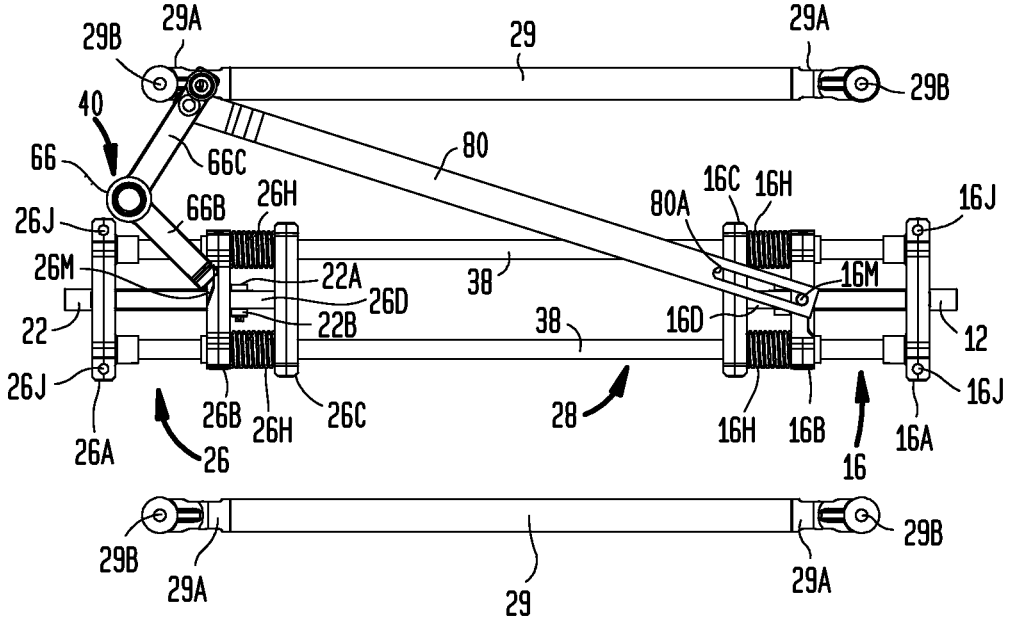
FIG. 10 is a cross-sectional view taken along line 10-10 in FIG. 9.
Figure 11:
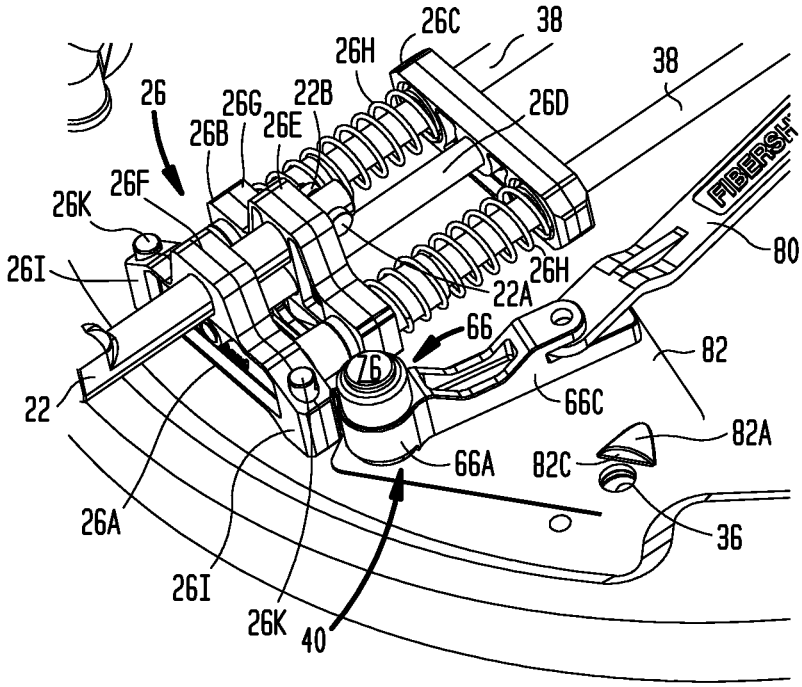
FIG. 11 is an enlarged fragmentary perspective view showing a latching drive mechanism of the manhole cover of FIG. 1 in an unlatched position.
Figure 12:
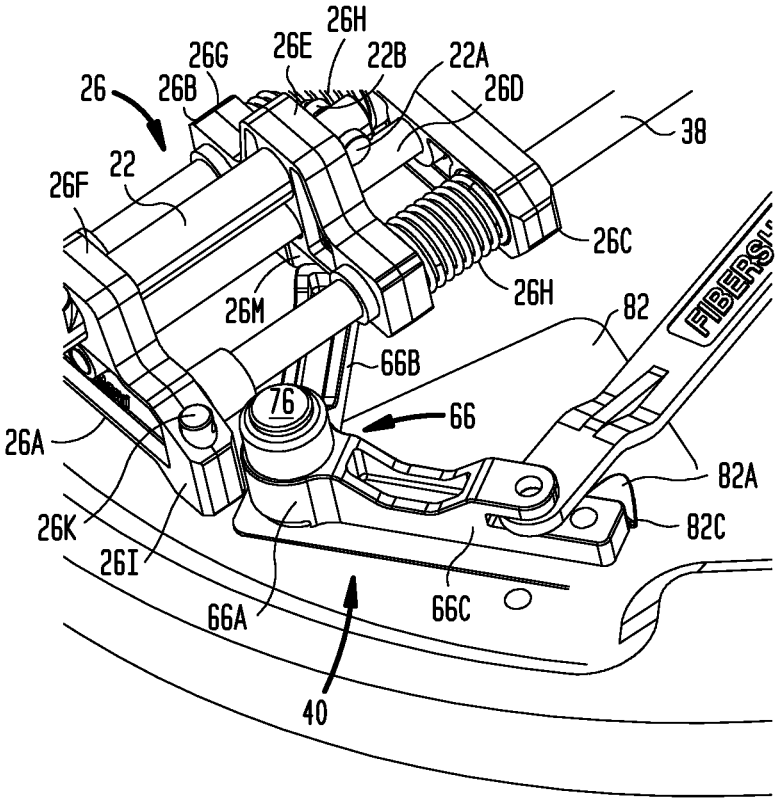
FIG. 12 is an enlarged fragmentary perspective view showing the latching drive mechanism of FIG. 11 in a latched position.

With additional reference now to FIGS. 11 and 12, a rotatable latching drive mechanism 40 is provided on the cover plate 6 to actuate the locking members 12/22 against the force of the biasing mechanism provided by the springs 14H/26H. The drive mechanism 40 has a locking rotational position (shown in FIGS. 3, 4, 6 and 11) wherein the locking members 16/26 are in the locked position, and an unlocking rotational position (shown in FIGS. 7, 8, 10 and 12) wherein the locking members are in the unlocked position.

Figure 13:
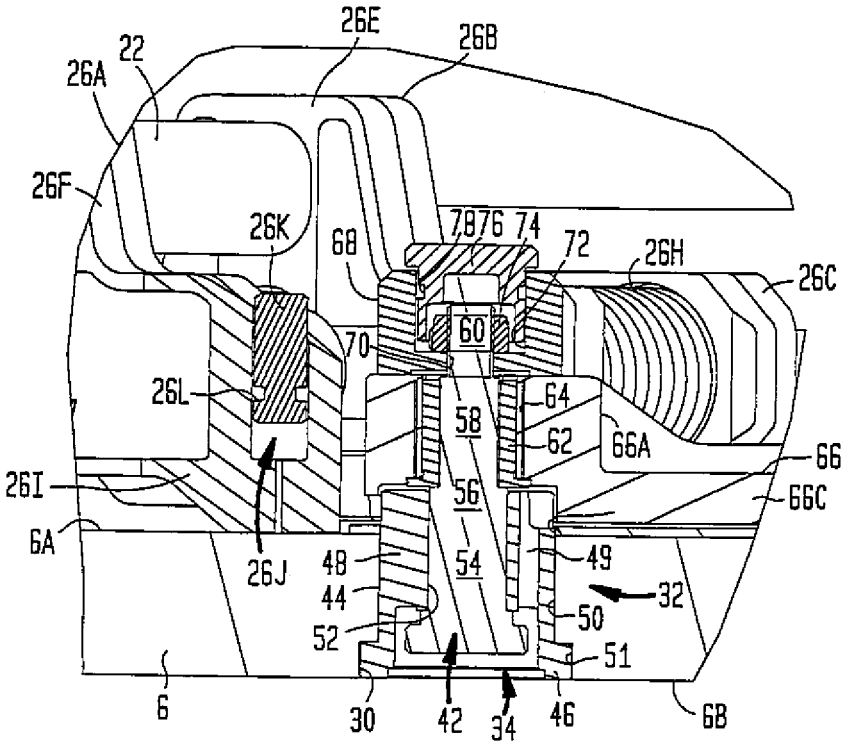
FIG. 13 is an enlarged fragmentary cross-sectional view showing an example construction of a portion of the latching drive mechanism of FIGS. 11 and 12.

As further shown in FIG. 13, the drive mechanism 40 includes a rotatable lock bolt 42 whose exposed face is configured to provide the security lock 34 (mentioned above in connection with FIG. 1). The rotatable lock bolt 42 is received in a fitting 44 that provides the lock housing 32 (also mentioned in connection with FIG. 1). The lock bolt 42 may be constructed from a non-corrosive metal, such as heat-treated copper, particularly if the cover plate 6 is used for sewer or other corrosive applications. For non-corrosive environments, a metal such as stainless steel may be used for the lock bolt 42. The lock housing fitting 44 may be formed from high-strength nylon or other suitable nonmetallic corrosion-resistant material. It may be attached to the cover plate 6 in any suitable fashion, such as by using epoxy adhesive. The lock housing fitting 44 has an enlarged head end 46 that is exposed at the upper surface 6B of the cover plate 6, and a stem 48. One side of the stem 48 may be formed with a drain hole 49 to prevent water collection and ice build-up in the area surrounding the security lock 34. The stem 48 is received in a narrowed portion 50 of the cover plate's lock aperture 30. The head end 46 of the lock housing fitting 44 situated in a counterbore portion 51 of the lock aperture 30. The lock housing fitting 44 is itself formed with a stepped bore 52 that extends through the head 46 and the stem 48 in order to receive the lock bolt 42.

The lock bolt 42 includes a head 54, a first medial portion 56, a second medial portion 58 and a stem 60 whose terminal end portion is threaded. The face of the head 54 is appropriately configured to provide the security lock 34. For example, although not shown, the head's security lock 34 may comprise an undulating curvilinear groove or other security lock pattern. The security lock pattern will thus be configured to receive a mating curvilinear ridge or other security key pattern formed on a security key (not shown). The first medial portion 56 of the lock bolt 42 is cylindrical in shape and rotatable in the bore 52 of the lock housing fitting 44. The second medial portion 58 of the lock bolt 42 is of non-cylindrical shape (e.g., square) in order to act as a drive member. The second medial portion 58 engages a bushing 62 made from a suitable non-corrosive metal (such as bronze). The bushing 62 has a non-circular (e.g., square) interior key-way that engages the lock bolt's second medial portion 58. The exterior of the bushing 62 is also non-circular (e.g., square). It is seated in a non-circular (e.g., square) aperture 64 in the hub 66A of a drive plate 66 that can be made from molded polymeric material or other nonmetallic corrosion-resistant material. One way to seat the bushing 62 in the aperture 64 is to mold the drive plate 66 around the bushing. This ensures a tight fit between the bushing and drive plate that will not loosen during operation of the drive mechanism 40.

A non-threaded base portion of the lock bolt stem 60 mounts a retainer 68 made from nylon or other nonmetallic corrosion-resistant material. The retainer 68 has a central bore 70 that fits over the aforesaid lock bolt stem base portion. The bore 70 is formed with a counterbore 72 to provide clearance for a lock nut 74 that threads onto the threaded end of the lock bolt stem 60 and captures the base of the retainer 68. The lock nut 74 can be made from any desired metal, including a corrosive metal, because it is protected from corrosive agents by a cap 76 that is seated in the end of the counterbore 72. The cap 76 can be made from nylon or other suitable nonmetallic corrosion-resistant material. If desired, the cap 76 may be provided with a circumferential groove 78 to receive an O-ring gasket (not shown) to help seal the counterbore interior.

Before leaving FIG. 13, it will be helpful to revisit the mounting configuration of the front towers 16A/26A. In FIG. 13, one of the lateral mounting flanges 26I of the front tower 26A is shown in cross-section. It will be seen that the sealing plug 26K is seated deeply in the counterbore portion of the through-bore 26J. The sealing plug 26K includes a circumferential groove 26L, which may be used to mount the O-ring gasket (not shown) that helps seal the counterbore interior. Although not shown in FIG. 13, the fastener head would sit below the sealing plug 26K and the fastener stem would extend through the non-counterbore portion of the through-bore, and into the cover plate 6. Note that only a portion of the non-counter bore portion of the through-bore 26J is shown in FIG. 13 because the plane of the cross-section does not extend through the through-bore centerline. For reference purposes, it should be noted that FIG. 13 also illustrates a portion of the central apertured flange 26E of the movable carriage 26B, a portion of the central apertured flange 26F of the front tower 26A, and a portion of the locking member 22. Also shown are a portion of the rear tower 26C and a portion of one of the springs 26H.

With additional reference now to FIGS. 11 and 12, it will be appreciated that rotation of the lock bolt 42 shown in FIG. 13 will effect rotation of the drive plate 66. FIG. 11 shows a locking rotational position of the drive plate 66 and FIG. 12 shows the drive plate's unlocking rotational position. The locking and unlocking rotational positions of the drive plate 66 are also respectively shown in FIGS. 3-6 and FIGS. 7-10. As will described in more detail below, the drive plate rotation actuates the locking members between their locked and unlocked positions. As stated, the drive plate 66 can be made from a suitable nonmetallic corrosion-resistant material. One such material is high-strength nylon.

In addition to the central hub 66A, the drive plate 66 also has a first drive arm 66B and a second drive arm 66C. The first drive arm 66B functions to drive the locking mechanism 26. In particular, it engages a lower cam surface 26M on the movable carriage 26B, as may be seen in FIG. 12 and also in FIGS. 6 and 10. Rotation of the first drive arm 66B from the locking position shown in FIG. 11 (also shown in FIGS. 3, 4 and 6) to the unlocking position shown in FIG. 12 (also shown in FIGS. 7, 8 and 10) slides the movable carriage 26B toward the rear tower 26C. This retracts the locking member 22 while compressing the springs 26H.

The second drive arm 66C functions to drive the locking mechanism 16. In particular, the end of the second drive arm 66C is rotatably pinned to a first end of a link member 80. Note that FIGS. 11 and 12 do not actually show the pin connector, but such a connector may be seen in FIG. 3. As best shown in FIGS. 4, 6, 8 and 10, the second end of the link member 80 extends under a portion of the locking mechanism 16 (e.g., the rear tower 16C) and is pivotally connected to the movable carriage 16B. As best shown in FIGS. 6 and 10, the movable carriage 16B may connect to the link member 80 by way of a pin 16M that slidably and rotatably engages a slot 80A formed at the second end of the link member 80. Rotation of the second drive arm 66C from the locking position shown in FIG. 11 (also shown in FIGS. 3, 4 and 6) to the unlocking position shown in FIG. 12 (also shown in FIGS. 7, 8 and 10) thus slides the movable carriage 16B toward the rear tower 16C. This retracts the locking member 12 while compressing the springs 16H.

With continuing reference to FIGS. 11 and 12, the second drive arm 66C is arranged to engage a latch 82A when it is rotated to the unlocking position shown in FIG. 12. The latch 82A may be formed as part of a thin flat base structure 82 that is mounted to the bottom 6A of the cover plate 6. A portion of the base structure 82 extends to the hub 66A of the drive plate 66, and is formed with an aperture 82B (see FIG. 13) that accommodates the lock housing fitting 44. The base structure 82 may be fabricated from nylon or other suitable nonmetallic corrosion-resistant material. It can be mounted to the lower cover plate surface 6A in any suitable manner, including by way of epoxy adhesive or other suitable bonding agent. As best shown in FIG. 11, the latch 82A has a sloping ramp surface that angles upwardly from the main surface of the base structure 82 and then abruptly terminates at a latch face 82C. The latch face 82C is adjacent to the cover plate access hole 36 mentioned above in connection with FIG. 1. As shown in FIG. 12, the latch face 82C captures the second drive arm 66C when the drive mechanism 40 is in its unlocking position. In this latched position, the second drive arm 66C cannot rotate back to the locking position, such that the locking members 12/22 will remain unlocked. Only by unlatching the second drive arm 66C can the locking members 12/22 be released.

When the manhole cover 6 is secured to the manhole frame 4, the locking members 12 and 22 are maintained in their locked position by the force of the biasing springs 16H/26H. The remaining components of the locking system 28 and the drive system 40 will also be in a locking position, as shown in FIGS. 3-6 and 11. When it is desired to disengage the manhole cover 6 from the manhole frame 4, the drive mechanism 40 is rotated. Rotation of the drive mechanism 40 from its locking position is effected by turning a security key (not shown) while it engages the security lock 34 on the head of the rotatable lock bolt 42. The unlocking direction is preferably counterclockwise when looking down on the cover plate 6. The security key rotates the rotatable lock bolt 42, which in turn rotates the drive plate 66. As the drive plate 66 rotates, the first drive arm 66A actuates the movable carriage 26B of the locking mechanism 26 against the biasing force of the springs 26H, thereby causing the locking member 22 to retract. Simultaneously, the second drive arm 66B actuates the link member 80, which in turn actuates the movable carriage 16B of the locking mechanism 16 against the biasing force of the springs 16H, thereby causing the locking member 16 to retract. As the springs 16H/26H are compressed, the person operating the security key tool will feel an increasing unlocking force.

Counterclockwise rotation of the drive mechanism 40 also results in the second drive arm 66C being pivoted toward the latch 82A. As can be seen in FIG. 12, the drive arm 66C is arranged in a horizontal plane that intersects the surface of the ramped surface of the latch 82A. As the second drive arm 66C rotates, it moves through this horizontal plane until it reaches the ramped latch surface. As the second drive arm 66C continues to rotate, the ramped latch surface will cause the second drive arm to bend elastically out of the horizontal plane, causing its fee end to displace away from the cover plate lower surface 6A. The second drive arm 66C will thus ride over the ramped surface and eventually snap into locking engagement with the latch face 82C due to the second drive arm returning to its undeformed position. In this configuration, the latch face 82C retains the second drive arm 66C against counter-rotation, which in turn maintains the drive mechanism 40 in its locking position. This means that the security key can be disengaged from the security lock and the manhole cover 6 can be removed from the manhole frame 4 and placed on the ground or other nearby surface with the locking members 12/22 in a retracted state.

The latch 82A is designed with a quick-release feature that allows the second drive arm 66C to be easily released once the cover plate 6 is ready to be re-secured to the manhole frame 4. In particular, the access hole 36 (FIG. 1) in the cover plate 6 accommodates a small diameter tool that can be used to contact the second drive arm 66C and downwardly deflect it out of engagement with the latch face 82C. Due to the relatively large biasing force imparted by the springs 16H/26H when the drive mechanism 40 is in the unlocking position, the drive mechanism 40 will snap back to its default locking position as soon as the second drive arm 66C clears the latch face 82C. The locking members 12/22 will therefore forcefully spring back to their locked position, thereby securing the cover plate 6 in position in the manhole frame 4.

A security key tool as disclosed in commonly-owned U.S. Pat. No. 7,708,742 may be used to both unlock and lock the cover plate 6. Rotation of the security lock 34 for approximately one-eighth of a turn (45°) should be sufficient to unlock the cover plate 6 and engage the second drive arm 66C against the latch face 82C. At this point, the security key may be disengaged from the security lock 34. A tool portion of the disclosed security key tool may be used to lift the cover plate 6 away from manhole frame 4 by providing the cover plate access opening 36 with threads that can be engaged by the tool. Preferably, this threaded engagement of the tool cannot result in the second drive arm 66C being inadvertently released from the latch 82A. This may be accomplished by ensuring that the threaded portion of the tool is not long enough to reach the second drive arm 66C.

When it is desired to replace the cover plate 6 on the manhole frame, the tool may be used to slide the cover plate into engagement with the manhole frame 4 so that the cover plate is dropped into fully-seated engagement with the manhole cover support surface 8. The drive mechanism 40 must then be released to secure the locking member 12/22 to the manhole frame 4. This may be accomplished using another portion of the security key tool disclosed in the above-referenced patent to engage the second drive arm 66C through the cover plate access opening 36 and activate the quick-release feature of the latch 82A.

Figure 14:
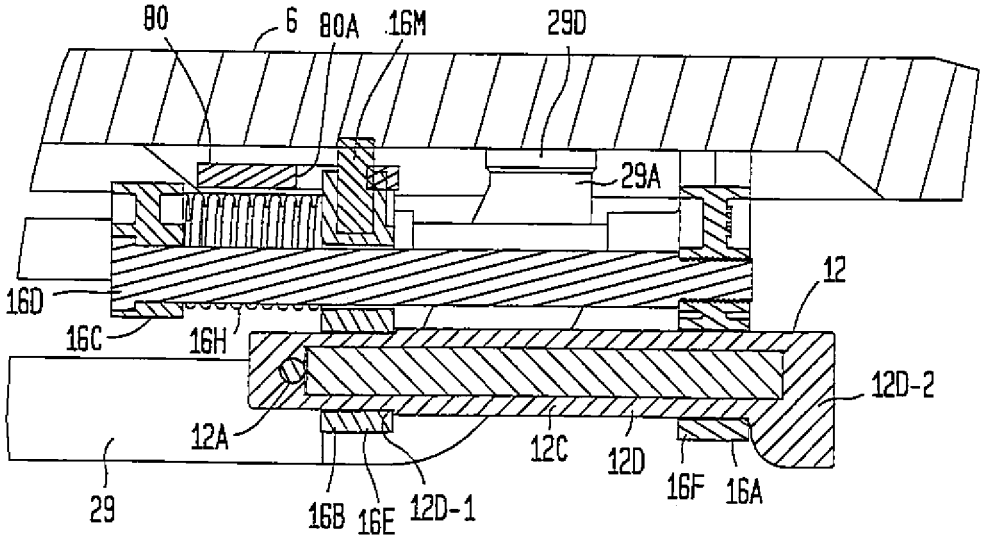
FIG. 14 is an enlarged fragmentary cross-sectional view showing an example construction of locking components of the manhole cover of FIG. 1.
Figure 15:
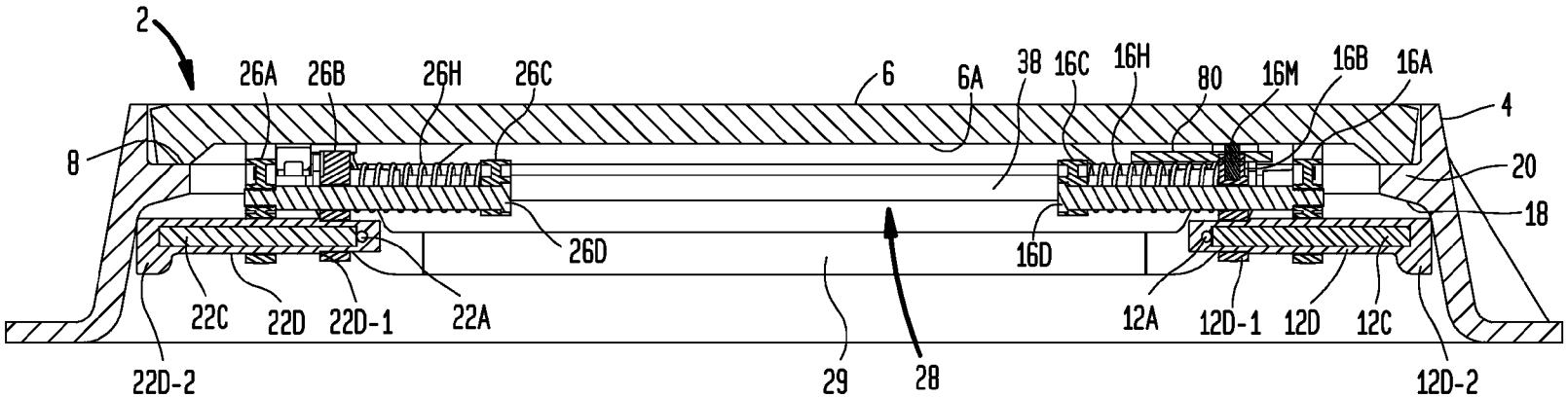
FIG. 15 is a cross-sectional centerline view of the manhole cover of FIG. 1 showing locking components thereof in a first adjustment position.
Figure 16:
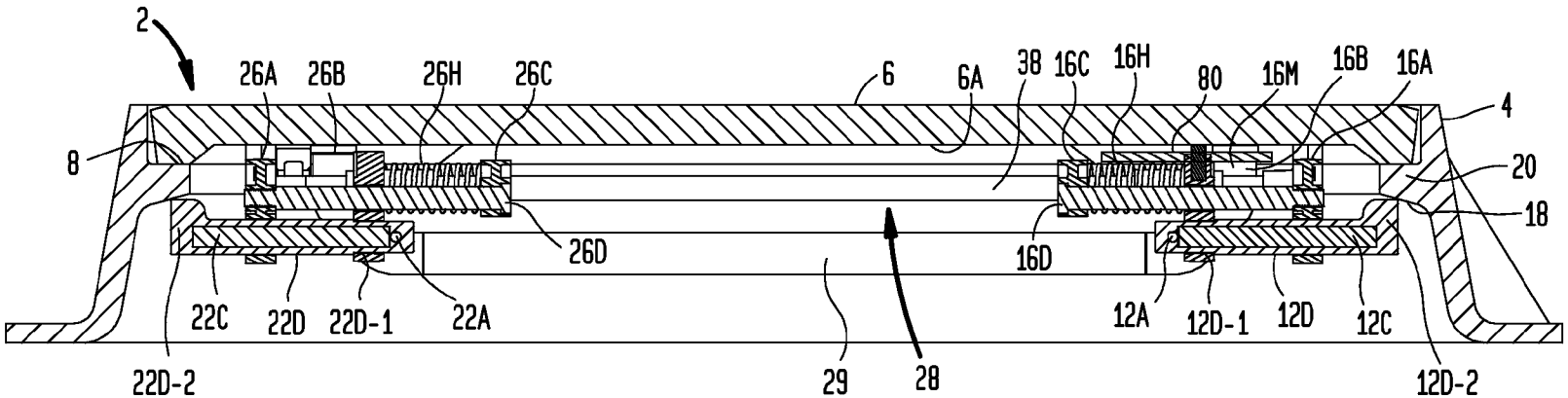
FIG. 16 is a cross-sectional centerline view of the manhole cover of FIG. 1 showing locking components thereof in a second adjustment position.

Turning now to FIG. 14, a cross-sectional view of the locking mechanism 16 illustrates a carriage bolt construction (as previously mentioned) that may be used to implement the connector 16D that connects the front tower 16A to the rear tower 16C. As additionally shown in FIGS. 15-16, an identical construction may be used for the connector 26D of the locking mechanism 26. FIG. 14 also illustrates an example construction of the locking member 12. As previously stated, an interior core of the locking member 12 may be constructed from fiberglass-filled polyester or other composite material and the outside may comprise an exterior covering made from high-strength nylon or other low-friction polymer for wear resistance. As further shown in FIGS. 15-16, the locking member 22 of the locking mechanism 26 may be constructed in the same manner. In FIGS. 14-16, the interior core of the locking members 12/22 is designated by reference numbers 12C/22C and the exterior covering is designated by reference numbers 12D/22D.

FIGS. 14-16 further illustrate a configuration of the locking member exterior covering 12D/22D that provides certain features and advantages. FIG. 14 illustrates this configuration in detail using the locking member 12 as an example. In FIG. 14, the exterior covering 12D of the locking member 12 is shown as including a shoulder 12D-1 that engages a side of the central flange 16E of the movable carriage 16B. The shoulder 12D-1 operates in conjunction with the retaining pin 12A to secure locking member 12 to the movable carriage 16B so that it moves in concert therewith during locking and unlocking operations. FIGS. 15-16 show that the locking member 22 uses the same configuration, namely a shoulder 22D-1.

FIG. 14 additionally shows that the locking member 12 may have a defined configuration that facilitates an adjustment feature thereof to accommodate different manhole frame geometries. In particular, the locking member 12 includes a main lock shaft portion disposed between the front tower 16A and the movable carriage 16B. The locking member 12 also includes a manhole frame-engaging portion extending outwardly from the front tower 16A. Here, the exterior cover 12D of the locking member 12 forms a bulbous tip 12D-2 that is configured as an oblong element. As can be seen in FIGS. 15-16, the locking member 22 has the same configuration, with the oblong bulbous tip being designated by reference number 22D-2.

As perhaps best shown in FIGS. 11 and 12, the main lock shaft portion of each locking member 12/22 has a non-circular shape that includes a pair of short mutually parallel sidewalls that are keyed to the apertured flanges of the front tower 16A/26A and the movable carriage 16B/26B. By removing the pin connectors 12A/22A, the locking members 12/22 can be slidably removed from their respective locking mechanisms 16/26, rotated 180 degrees about a central longitudinal axis of the locking member main lock shaft portion, and reinstalled. This will invert the bulbous tip 12D/22D of each locking member 12/22 between the downwardly-extending orientation shown in FIG. 15 and the upwardly-extending orientation of FIG. 16. In this way, the locking members 12/22 will be adjustable between first and second adjustment positions to accommodate manhole frames of different size or configuration. For example, FIG. 15 shows the locking members 12/22 engaging the manhole frame 4 below the lower surface 18 of the cover support flange 20. This may or may not be the most advantageous location for the locking members 12/22 to engage the manhole frame 4. FIG. 16 shows that the locking members 12/22 have been rotated so that they engage the lower surface 18 itself. This may provide a more robust cover-to-frame locking arrangement. On the other hand, the locking member configuration of FIG. 15 will allow the cover 6 to be used in a manhole frame having a deeper flange depth.

Figure 17:
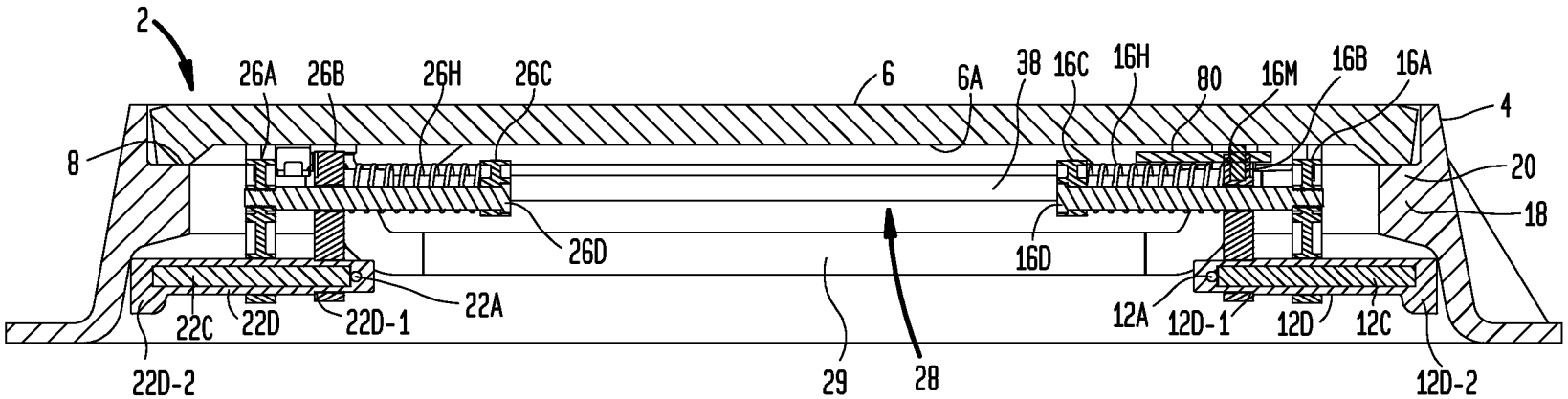
FIG. 17 is a cross-sectional centerline view of the manhole cover of FIG. 1 showing alternative locking components thereof in a first adjustment position.
Figure 18:
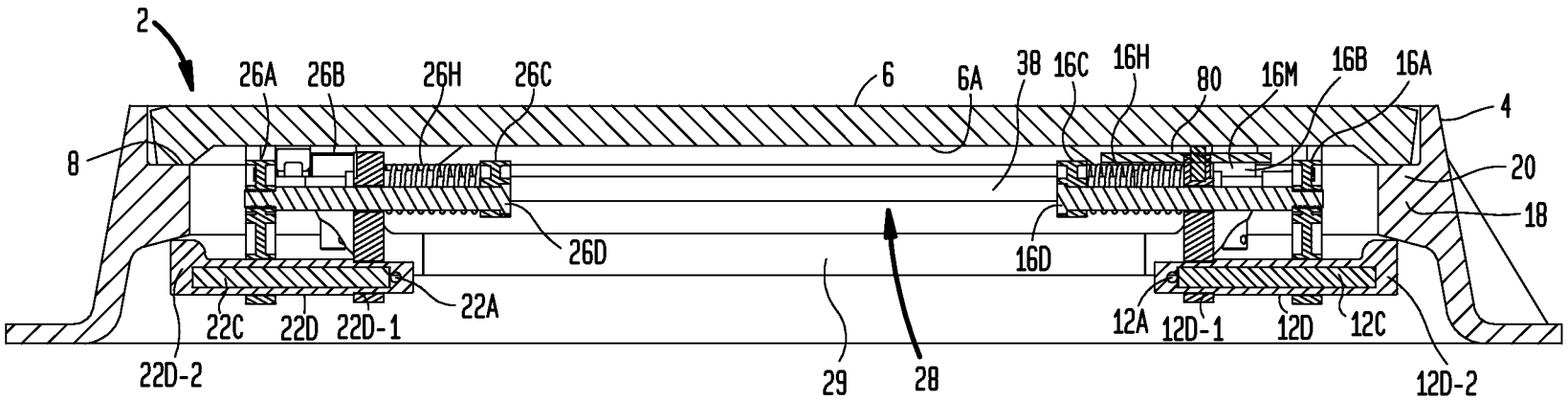
FIG. 18 is a cross-sectional centerline view of the manhole cover of FIG. 1 showing alternative locking components thereof in a second adjustment position.

FIGS. 17 and 18 illustrate the same rotational adjustment capability of the locking members 12/22. In addition, FIGS. 17 and 18 show that further accommodation of varying manhole frame configurations may be obtained by changing the height of the front tower 16A/26A and movable carriage 16B/26B of the locking mechanisms 16/26. Thus, the cover plate 6 could provided with a set of several front tower and movable carriage components of different height. In this way, the cover plate 6 could be factory-modified or field-modified to fit various manhole frame types.

Figure 19:
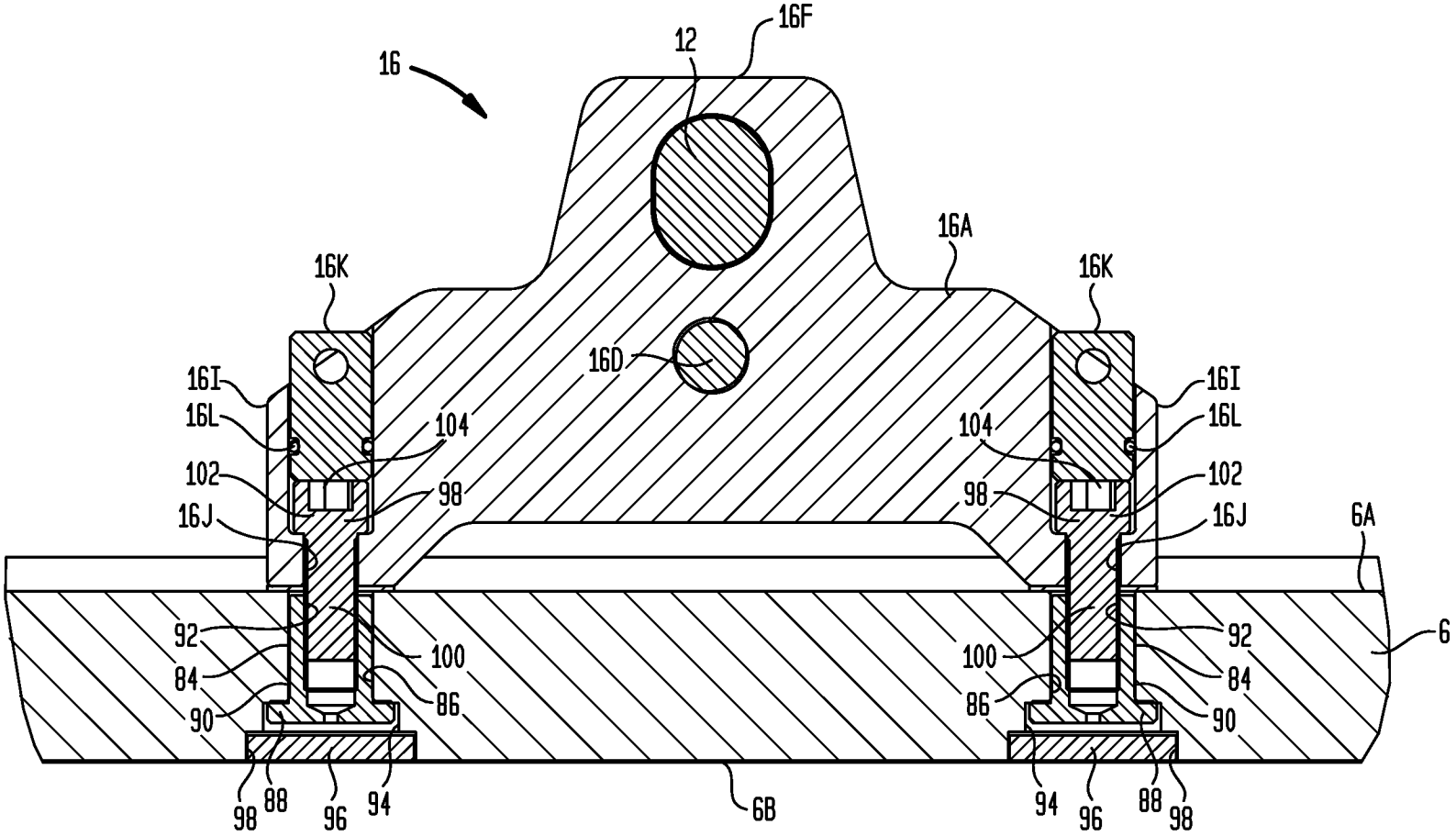
FIG. 19 is a cross-sectional view showing a main tower portion of one of the locking components of the manhole cover of FIG. 1, according to an alternate embodiment.

FIG. 19 illustrates a further embodiment in which the security capabilities of the disclosed manhole cover plate 6 are increased using an alternative mounting technique for attaching the locking mechanisms 16/26. Using the locking mechanism 16 as an example, FIG. 19 depicts how the front tower 16A can be mounted to the cover plate 6 using flanged anchors 84. The anchors 84 are each mounted in a stepped bore 86 that extends from the upper cover plate surface 6B to the lower cover plate surface 6A. The anchors 84 are preferably formed from a high strength metal that is corrosion-resistant, such as stainless steel. Each anchor 84 includes an upper head flange 88 and a lower stem 90 formed with an internally threaded bore 92. The anchor head flange 88 seats at the bottom of a first counterbore portion 94 of the stepped bore 86. If desired for aesthetic purposes, the anchor head flange 88 may be covered by an optional disk-shaped insert 96, made from a suitable non-metallic corrosion-resistant material, that seats at the bottom of a second counterbore portion 98 of the stepped bore. As additionally shown in FIGS. 23-24, the upper side surface of the insert 96 is preferably flush with the cover plate upper surface 6B.

The front tower 16 is secured to the anchors 84 using threaded lock bolts 98. Each lock bolt 98 has an externally threaded shank 100 that inserts through one of the front tower bores 16J and threads into the internally threaded bore 92 of one of the anchors 84. Each lock bolt 98 also has an enlarged lock bolt head 102 that seats at the bottom of a counterbore portion of one of the front tower bores 16J. Each lock bolt head head 102 is covered by one of the sealing plugs 16K (which are depicted with their circumferential grooves 16L occupied by O-rings). A tool engaging pattern, such as a patterned channel 104, is formed on each lock bolt head. Tightening the lock bolts 98 applies a tightening force that tends to pull the anchors 84 toward the front tower 16. This force is resisted by the anchor head flanges 88 due to their engagement with the bottom of the first counterbore portion 94 of the stepped bore 86. Advantageously, this arrangement can resist large forces applied to the front tower 16 should an attempt be made to dislodge the cover plate 6 using pry bars or the like. This is deemed to be superior to simply threading the lock bolts 98 into the cover plate 6, or into an insert that is press-fit into the lower cover plate surface 6A. To provide additional security, it would also be possible to form the front tower 16 (as well as the front tower 26) out of a suitable metal, such as cast steel. A metal is not particularly corrosion-resistant could be used for relatively non-corrosive environments. For corrosive environments, a corrosion-resistant or non-corrosive metal may be used.

Figure 20:
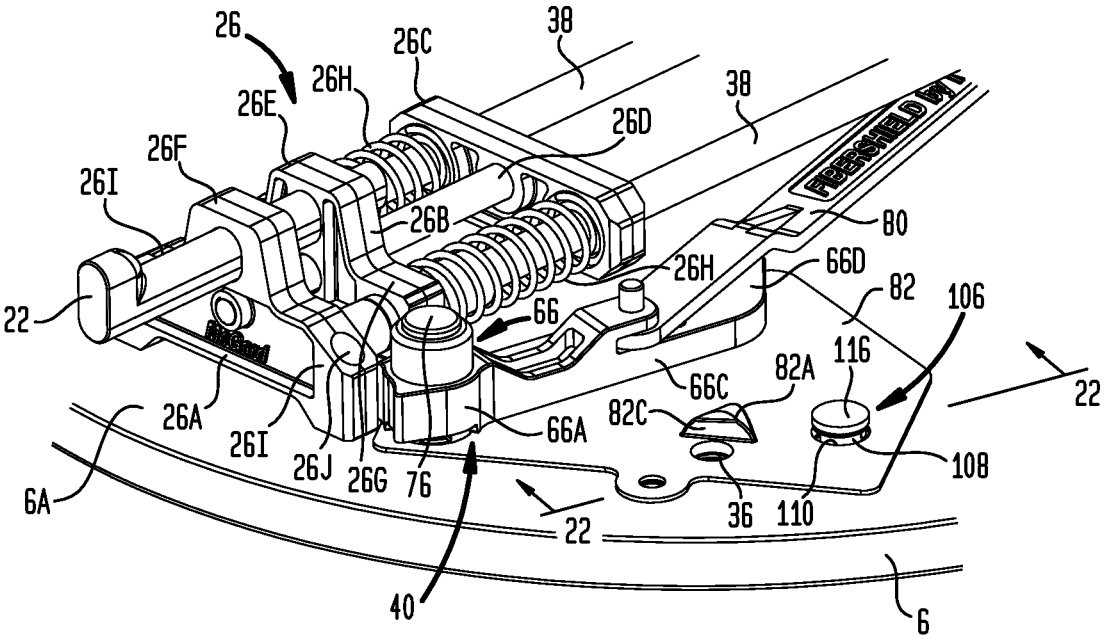
FIG. 20 is a an enlarged fragmentary perspective view showing a latching drive mechanism of the manhole cover of FIG. 1 in a latched position, according to an alternate embodiment.
Figure 21:
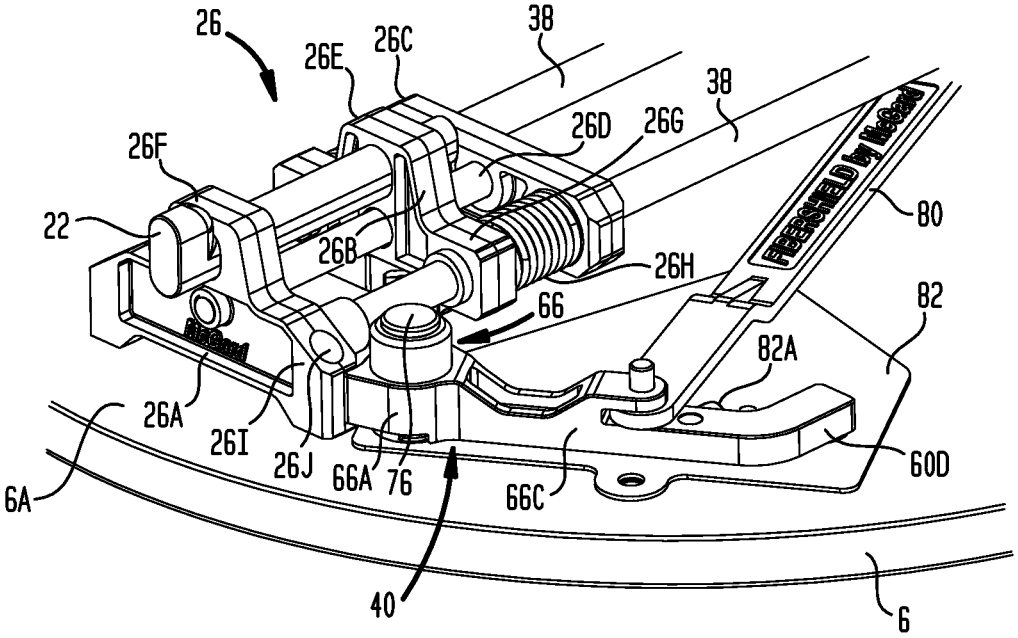
FIG. 21 is an enlarged fragmentary perspective view showing the latching drive mechanism of FIG. 20 in an unlatched position.
Figure 22:
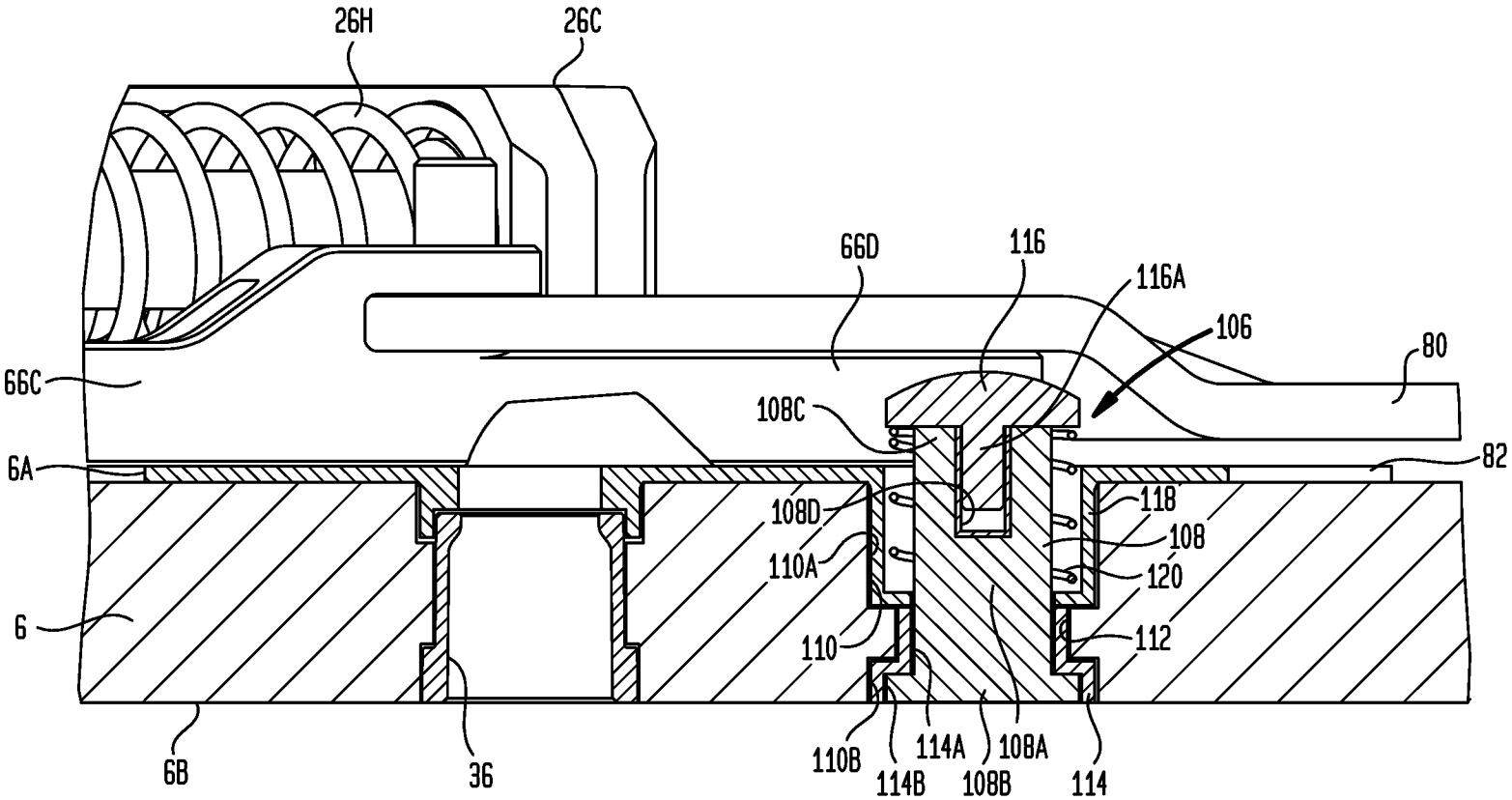
FIG. 22 is a cross-sectional view taken along line 22-22 in FIG. 20.

Turning now to FIGS. 20-24, a further embodiment is illustrated in which the latching mechanism 40 is substantially the same as described above in connection with FIGS. 11 and 12, but includes an additional quick-latch mechanism 106 (see FIG. 20) for quickly latching the cover plate 6 following installation in the manhole frame 4. As can be seen in FIG. 20, the quick-latch mechanism 106 includes a plunger 108 that is arranged to engage an extension 66D of the second drive arm 66C of the drive plate 66. The plunger 108 can be made from a suitable nonmetallic corrosion-resistant material. As best shown in FIG. 22, the plunger 108 resides in an aperture 110 that extends from the upper cover plate surface 6B to the lower cover plate surface 6A. The aperture 110 is formed with a central annular flange 112 that defines a lower aperture region 110A and an upper aperture region 110B. The upper aperture region 110B seats a stepped bushing 114 that can be made from a suitable non-metallic corrosion-resistant material. A lower portion 114A of the stepped bushing 114 slidably receives an elongated stem 108A of the plunger 108. An upper portion 114B of the bushing 114 seats a head flange 108B of the plunger 108.

The lower aperture region 110A houses the lower extremity of the plunger stem 108A. Optionally, the lower aperture region 110A can also be used to mount a cup-shaped post 118 of the base structure 82 that assists in securing the base structure to the cover plate 6. A lower end 108C of the plunger 108 extends past the lower cover plate surface 6A. It mounts a button member 116 that has a smooth rounded surface. The button member 116 has a short stem 116A that inserts into a bore 108D formed in the plunger lower end 108C. The stem 116A may be secured in the bore 108D in any suitable manner, such as by adhesive bonding. A coil spring 120, made from a suitable corrosion-resistant or non-corrosive metal, is disposed on the plunger stem 108A. A lower end of the spring 120 engages, and is thereby supported, by the button 116 and an upper end of the spring engages the bottom of the cup shaped post 118, and is thereby supported by the central annular flange 112 of the aperture 110. The spring 120 imparts downward bias to the plunger 108.

Figure 23:
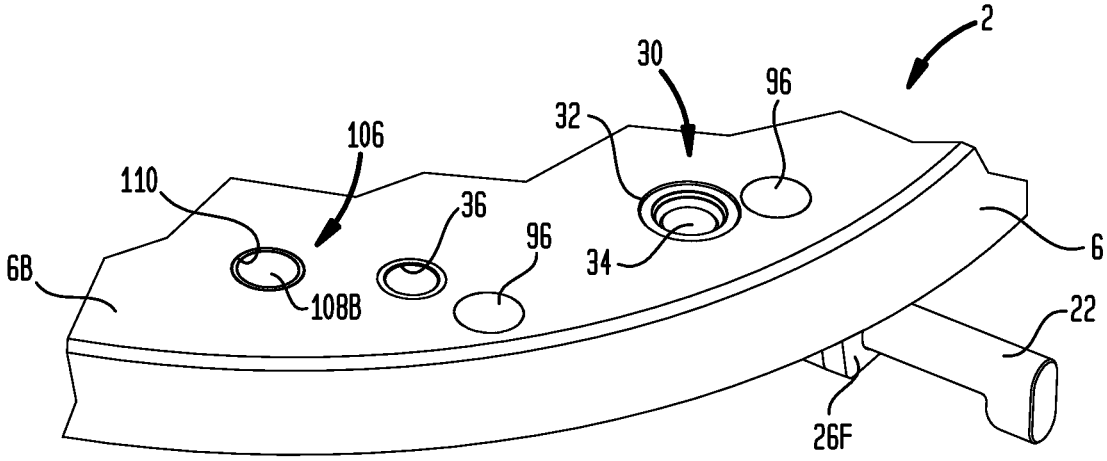
FIG. 23 is a an enlarged fragmentary perspective view corresponding to FIG. 20 but showing components of the latching drive mechanism in their latched position from the vantage point of an upper surface of the manhole cover.
Figure 24:
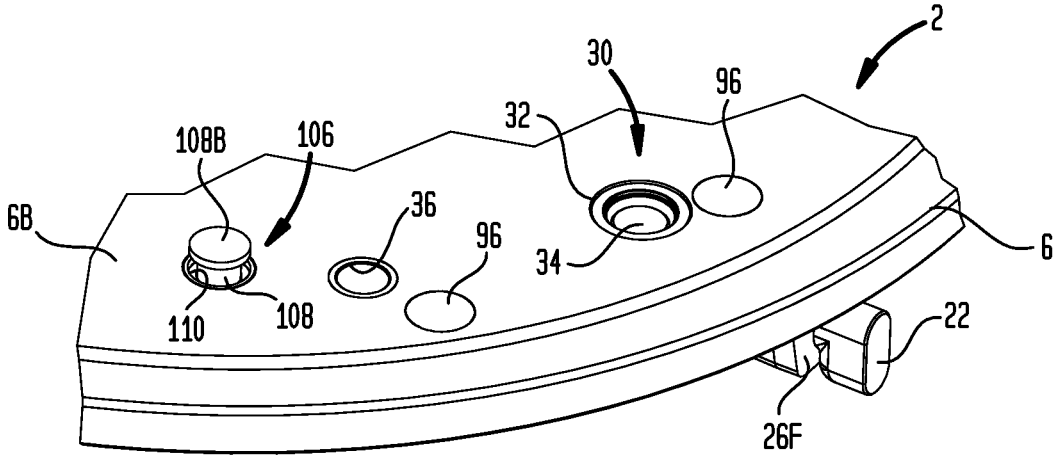
FIG. 24 is a an enlarged fragmentary perspective view corresponding to FIG. 20 but showing components of the latching drive mechanism in their unlatched position from the vantage point of an upper surface of the manhole cover.

FIGS. 20, 22 and 23 show the cover plate 6 with the locking member 22 in its locked position. In this position, the second drive arm extension 66D does not engage the button member 116 and the plunger 108 is biased by the spring 120 to its lowermost position. As can be seen in FIG. 23, the top of the plunger's head flange 108B is substantially flush with the upper cover plate surface 6B. FIGS. 21 and 24 show the cover plate 6 with the locking member 22 in its unlocked position. In this position, the second drive arm extension 66D slides over the button member 116, which is rounded to provide a cam surface, and depresses the plunger 108 to its uppermost position against the biasing force of the spring 120. Note that the stiffness of the spring 120 is selected so that it is not so large as to prevent the plunger from fully depressing when it is engaged by the second drive arm 66C. This could prevent the second drive arm from engaging the face 82C of the latch 82A, such that the locking member 22 would not remain in its unlocked position. It will be seen in FIG. 24 that the plunger head flange 108B extends upwardly from the upper cover plate surface 24. Securing the cover plate 6 to the manhole frame 4 is now a simple matter of using one's foot to step down on the plunger head flange 108B. This action forces the plunger 108 and the button member 116 downwardly against the second drive arm 66C, causing it to downwardly deflect out of engagement with the latch face 82C and release the locking member 22 (as well as the locking member 12) from its locking position. The plunger 108 could also be actuated using one's hand. In either case, no special device such as a tool or key is needed.

Accordingly, a self-locking manhole cover for securing a manhole access opening and comprising nonmetallic corrosion-resistant materials has been disclosed. While example embodiments have been shown and described, it should be apparent that many variations and alternative embodiments could be implemented in accordance with the teachings herein. For example, the disclosed embodiments feature a latching configuration wherein the drive mechanism 40 is axially fixed relative to the cover plate 6 and the second drive arm 66C is deflected out of engagement with the latch face 82C to effect unlatching. In an alternative embodiment, the second drive arm 66C could be disengaged from the latch face 82C without having to deflect if the entire drive mechanism 40 was downwardly positionable relative to the cover plate 6. In that case, the drive mechanism 40 could be urged downwardly (e.g., against a biasing force) in order to disengage the second drive arm 66C from the latch 82A. In a further modification, the drive mechanism 40 could be provided with a dedicated latch arm for latching the mechanism in the unlocking position (instead of using one of the drive arms). In a further modification, the quick-latch mechanism 106 could be used with a self-locking manhole cover that is not corrosion-resistant, or is only partially corrosion-resistant. It is understood, therefore, that the invention is not to be in any way limited except in accordance with the spirit of the appended claims and their equivalents.

What is claimed is:

1. A corrosion-resistant self-locking manhole cover, comprising:

a cover plate comprising nonmetallic corrosion-resistant material, said cover plate being adapted to rest on a manhole cover support surface of a manhole frame so as to be substantially flush with a top portion of said manhole frame and a surrounding surface in which said manhole frame is situated;

an anchor on said cover plate comprising nonmetallic corrosion-resistant material, said anchor being adapted to engage said manhole frame at a first location in a manner that resists lifting of said cover plate proximate to said first location;

a locking member on said cover plate comprising nonmetallic corrosion-resistant material, said locking member being movable between a locked position in which said locking member is adapted to engage said manhole frame at a second location in a manner that resists lifting of said cover plate proximate to said second location, and an unlocked position in which said locking member is not adapted to engage said manhole frame;

said locking member being biased by a biasing force to said locked position;

a drive mechanism operable to retract said locking member against said biasing force from said locked position and retain said locking member in said unlocked position;

said drive mechanism comprising a security lock on an upper side of said cover plate and engageable by a key to operate said drive mechanism to retract said locking member;

a quick-latch mechanism operable without using a key or other tool to interact with said drive mechanism to release said locking member from said unlocked position to allow said locking member to return to said locked position;

said quick-latch mechanism comprising a plunger that can be actuated from an upper surface of said cover plate; and wherein said plunger does not extend above said upper cover plate surface when said locking member is in said locked position, and wherein said plunger extends above said upper cover plate surface when said locking member is in said unlocked position.

2. A manhole cover in accordance with claim 1, wherein said plunger comprises a non-metallic corrosion-resistant material.

3. A manhole cover in accordance with claim 1, wherein said quick-latch mechanism comprises a biasing member that biases said plunger to a position where said plunger does not extend above said upper cover plate surface.

4. A manhole cover in accordance with claim 3, wherein said biasing member comprises a corrosion-resistant or non-corrosive metal spring.

5. A manhole cover in accordance with claim 1, said drive mechanism comprises a rotatable drive mechanism on said cover plate whose components comprise nonmetallic corrosion-resistant material, said drive mechanism being operatively connected to said locking member and having a locking rotational position wherein said locking member is in said locked position and an unlocking rotational position wherein said locking member is in said unlocked position.

6. A manhole cover in accordance with claim 5, wherein said drive mechanism includes a latch comprising nonmetallic corrosion-resistant material on a lower side of said cover plate adapted to releasably retain said drive mechanism in said unlocking rotational position, said quick-latch mechanism being operable to release said drive mechanism from said unlocking rotational position.

7. A manhole cover in accordance with claim 6, wherein said drive mechanism comprises a drive arm that operably engages said latch in said unlocking rotational position, said quick-latch mechanism is operable to disengage said drive arm from said latch.

8. A corrosion resistant self-locking manhole cover, comprising:

a nonmetallic corrosion-resistant cover plate adapted to rest on a manhole cover support surface of a manhole frame so as to be substantially flush with a top portion of said manhole frame and a surrounding surface in which said manhole frame is situated;

a first nonmetallic corrosion-resistant locking member on said cover plate that is movable between a locked position in which said first locking member is adapted to engage said manhole frame at a first location in a manner that resists lifting of said cover plate proximate to said first location, and an unlocked position in which said first locking member is not adapted to engage said manhole frame;

a second nonmetallic corrosion-resistant locking member on said cover plate that is movable between a locked position in which said second locking member is adapted to engage said manhole frame at a second location in a manner that resists lifting of said cover plate proximate to said second location, and an unlocked position in which said second locking member is not adapted to engage said manhole frame;

a spring mechanism adapted to bias said first locking member and said second locking member to said locked position;

an aperture in said cover plate;

a fitting in said cover plate aperture having a metallic rotatable lock bolt with a nonmetallic corrosion-resistant exterior on a bottom side of said cover plate;

a first nonmetallic corrosion-resistant drive arm operatively driven by said rotatable lock bolt, said first drive arm operatively engaging said first locking member and having a locking rotational position wherein said first locking member is in said locked position and an unlocking rotational position wherein said first locking member is in said unlocked position;

a second nonmetallic corrosion-resistant drive arm operatively driven by said rotatable lock bolt, said second drive arm operatively engaging said second locking member and having a locking rotational position wherein said second locking member is in said locked position and an unlocking rotational position wherein said second locking member is in said unlocked position;

said rotatable lock bolt comprising a security lock disposed in said cover plate aperture and adapted to receive a security key tool that applies a rotational torque to said security lock;

a nonmetallic corrosion-resistant latch on said cover plate adapted to releasably retain said second drive arm in said unlocking rotational position without said security lock being engaged by said security key tool;

a quick-latch mechanism operable without using a key or other tool to release said first locking member and said second locking member from their unlocked position to allow said first locking member and said second locking member to return to their locked position;

said quick-latch mechanism comprising a plunger that can be actuated from an upper surface of said cover plate; and wherein said plunger does not extend above said upper cover plate surface when said first locking member and said second locking member are in said locked position, and wherein said plunger extends above said upper cover plate surface when said first locking member and said second locking member are in said unlocked position.

9. A manhole cover in accordance with claim 8, wherein said plunger comprises a non-metallic corrosion-resistant material.

10. A manhole cover in accordance with claim 8, wherein said quick latch mechanism comprises a biasing member that biases said plunger to a position where said plunger does not extend above said upper cover plate surface.

11. A manhole cover in accordance with claim 10, wherein said biasing member comprises a corrosion-resistant or non-corrosive metal spring.

12. A manhole cover in accordance with claim 8, wherein said quick-latch mechanism is arranged to interact with said second drive arm in order to release said second drive arm from engagement with said latch.

13. A manhole cover in accordance with claim 8, wherein said first locking member and said second locking member are respectively carried by first and second locking mechanisms that are secured to said cover plate using flanged anchors that are each mounted in a stepped bore that extends from an upper cover plate surface to a lower cover plate surface.

14. A manhole cover in accordance with claim 13, wherein portions of said locking mechanism that are secured using said flanged anchors comprise a metal material.

15. A corrosion resistant self-locking manhole cover, comprising:

a nonmetallic corrosion-resistant cover plate adapted to rest on a manhole cover support surface of a manhole frame so as to be substantially flush with a top portion of said manhole frame and a surrounding surface in which said manhole frame is situated;

a first nonmetallic corrosion-resistant locking member on said cover plate that is movable between a locked position in which said first locking member is adapted to engage said manhole frame at a first location in a manner that resists lifting of said cover plate proximate to said first location, and an unlocked position in which said first locking member is not adapted to engage said manhole frame;

a second nonmetallic corrosion-resistant locking member on said cover plate that is movable between a locked position in which said second locking member is adapted to engage said manhole frame at a second location in a manner that resists lifting of said cover plate proximate to said second location, and an unlocked position in which said second locking member is not adapted to engage said manhole frame;

a spring mechanism adapted to bias said first locking member and said second locking member to said locked position;

an aperture in said cover plate;

a fitting in said cover plate aperture having a metallic rotatable lock bolt with a nonmetallic corrosion-resistant exterior on a bottom side of said cover plate;

a first nonmetallic corrosion-resistant drive arm operatively driven by said rotatable lock bolt, said first drive arm operatively engaging said first locking member and having a locking rotational position wherein said first locking member is in said locked position and an unlocking rotational position wherein said first locking member is in said unlocked position;

a second nonmetallic corrosion-resistant drive arm operatively driven by said rotatable lock bolt, said second drive arm operatively engaging said second locking member and having a locking rotational position wherein said second locking member is in said locked position and an unlocking rotational position wherein said second locking member is in said unlocked position;

said rotatable lock bolt comprising a security lock disposed in said cover plate aperture and adapted to receive a security key tool that applies a rotational torque to said security lock;

a nonmetallic corrosion-resistant latch on said cover plate adapted to releasably retain said second drive arm in said unlocking rotational position without said security lock being engaged by said security key tool;

said first locking member and said second locking member being respectively carried by first and second locking mechanisms that are secured to said cover plate using flanged anchors that are each mounted in a stepped bore that extends from an upper cover plate surface to a lower cover plate surface, said flanged anchors having a head flange seated in a first counterbore portion of said stepped bore;

a disk-shaped insert comprising non-metallic corrosion-resistant material that seats in a second counterbore portion of said stepped bore to cover said head flange;

a quick-latch mechanism operable without using a key or other tool to release said first locking member and said second locking member from their unlocked position to allow said first locking member and said second locking member to return to their locked position;

said quick-latch mechanism comprising a plunger that can be actuated from an upper surface of said cover plate; and wherein said plunger does not extend above said upper cover plate surface when said first locking member and said second locking member are in said locked position, and wherein said plunger extends above said upper cover plate surface when said first locking member and said second locking member are in said unlocked position.

16. A self-locking manhole cover, comprising:

a cover plate adapted to rest on a manhole cover support surface of a manhole frame so as to be substantially flush with a top portion of said manhole frame and a surrounding surface in which said manhole frame is situated;

an anchor on said cover plate adapted to engage said manhole frame at a first location in a manner that resists lifting of said cover plate proximate to said first location;

a locking member on said cover plate movable between a locked position in which said locking member is adapted to engage said manhole frame at a second location in a manner that resists lifting of said cover plate proximate to said second location, and an unlocked position in which said locking member is not adapted to engage said manhole frame;

said locking member being biased by a biasing force to said locked position;

a drive mechanism operable to retract said locking member against said biasing force from said locked position and retain said locking member in said unlocked position;

said drive mechanism comprising a security lock on an upper side of said cover plate and engagable by a key to operate said drive mechanism to retract said locking member;

quick-latch mechanism operable without using a key or other tool to interact with said drive mechanism to release said locking member from said unlocked position to allow said locking member to return to said locked position;

said quick-latch mechanism comprising a plunger that can be actuated from an upper surface of said cover plate; and wherein said plunger does not extend above said upper cover plate surface when said locking member is in said locked position, and wherein said plunger extends above said upper cover plate surface when said locking member is in said unlocked position.

* * * * *